US010905260B2

(12) United States Patent
Hara et al.

(10) Patent No.: US 10,905,260 B2
(45) Date of Patent: Feb. 2, 2021

(54) DISPLAY HUTCH

(71) Applicant: WestRock Shared Services, LLC, Atlanta, GA (US)

(72) Inventors: Hidenobu Hara, Danbury (JP); Justin Bologna, Greenwich, CT (US); Michael Bender, Fairfield, CT (US)

(73) Assignee: WestRock Shared Services, LLC, Atlanta, GA (US)

( * ) Notice: Subject to any disclaimer, the term of this patent is extended or adjusted under 35 U.S.C. 154(b) by 13 days.

(21) Appl. No.: 16/160,574

(22) Filed: Oct. 15, 2018

(65) Prior Publication Data

US 2020/0113355 A1 Apr. 16, 2020

(51) Int. Cl.
*A47F 5/11* (2006.01)

(52) U.S. Cl.
CPC ..... *A47F 5/116* (2013.01); *A47F 5/114* (2013.01)

(58) Field of Classification Search
CPC ..... A47F 5/116; A47F 5/0018; A47F 5/11; A47F 5/114; A47B 43/02; A47B 47/06
See application file for complete search history.

(56) References Cited

U.S. PATENT DOCUMENTS 3,167,179 A * 1/1965 Goldstein ..... B65D 73/00 206/763
3,918,576 A * 11/1975 Taub ..... B65D 5/5206 206/764
4,191,288 A * 3/1980 Hostad ..... B65D 5/5206 206/764
4,314,685 A * 2/1982 Schwan ..... A47B 57/04 248/242
6,612,669 B2 * 9/2003 Grueneberg ..... A47B 43/02 108/165
7,717,265 B2 * 5/2010 Honkawa ..... A47F 3/142 206/386
8,485,370 B2 * 7/2013 Dewhurst ..... A47F 5/116 211/135
9,078,296 B2 * 7/2015 Fitzwater ..... H05B 6/6408
2004/0016375 A1 * 1/2004 Grueneberg ..... A47B 43/02 108/115
2004/0089702 A1 * 5/2004 Southwell ..... B65D 5/002 229/120.08
2004/0148825 A1 * 8/2004 Myers ..... A47F 5/116 40/124
2015/0068998 A1 * 3/2015 Smith ..... A47F 5/116 211/135
2017/0231404 A1 * 8/2017 Pratsch, Jr. ..... A47F 5/116 211/135

* cited by examiner

*Primary Examiner* — Ko H Chan
(74) *Attorney, Agent, or Firm* — John Swingle

(57) ABSTRACT

A container includes a plurality of panels connected together at fold lines configured for extending at least partially around an interior space. The panels include a front panel, a first side panel, a back panel and a second side panel. The back panel includes a first back portion and a second back portion. At least one of the first back portion or the second back portion is free from openings. A shelf panel is foldably connected to the front panel. The first back portion is adhered to the shelf panel.

15 Claims, 21 Drawing Sheets

DISPLAY HUTCH

BACKGROUND OF THE INVENTION

1. Field of the Invention

The present disclosure relates to displays, and more particularly to shelves for retail merchandising displays.

2. Description of Related Art

In the retail environment, various containers are provided for display of a product, such as hutch or floor-stand style displays, or other shelving unit systems. The pre-assemblies for conventional displays are typically shipped to their retail location and then final set up is done in-store. Hutch style or floor-stand style displays can be used for a variety of products, some of which can be heavy and require supportive shelving.

The conventional techniques for shelves in displays such as hutch or floor-stand style displays been considered satisfactory for their intended purpose. However, there is an ever present need for improved displays with reduced shelf sagging, reduced material usage and increased weight capacity. This disclosure provides a solution for this need.

SUMMARY OF THE INVENTION

A shelf includes a plurality of panels connected together at fold lines. The plurality of panels includes a front panel, a top panel, a bottom panel and a back panel. At least one of the fold lines includes a line of weakness having an arcuate shape.

Inner surfaces of the top and bottom panels can be adhered to one another. In accordance with some embodiments, the fold line between the front panel and the top panel includes one of the fold lines that includes the line of weakness having the arcuate shape. The fold line between the top panel and the back panel can include one of the fold lines that includes the line of weakness having the arcuate shape.

It is contemplated that the shelf can include a tab extending from the top panel. The tab can be cut from at least one of the back panel or the bottom panel. The bottom panel can include a primary bottom panel and a secondary bottom panel. An intermediate bottom panel can be connected between the primary and secondary bottom panels at fold lines. The fold line between the secondary bottom panel and the intermediate bottom panel includes a line of weakness having an arcuate shape. The bottom panel can include a bottom panel support beam formed by first and second bottom angled panels. The first bottom angled panel is connected to the primary bottom panel at a respective fold line and the second bottom angled panel is connected to the first bottom angled panel at a support beam fold line. The support beam fold line includes a line of weakness having an arcuate shape. The bottom panel includes a bottom adhesion panel. The bottom adhesion panel is connected to the second bottom angled panel at a respective fold line.

The shelf can include two front adhesion panels. A first one of the two front adhesion panels can be connected to the front panel at a fold line. A second one of the two front adhesion panels can be connected to the first front adhesion panel at an adhesion panel fold line. The first and second front adhesion panels can be folded about the adhesion panel fold line to abut one another. The shelf can include a shelf clip adhered to at least one of the first or second adhesion panels, wherein the shelf clip is adhered between the first and second adhesion panels.

In accordance with another aspect, a blank for a shelf includes a plurality of panels connected together along respective fold lines configured to be folded. The plurality of panels includes a front panel, a top panel, a bottom panel and a back panel. At least one of the fold lines includes a line of weakness having an arcuate shape.

In accordance with some embodiments, the fold line between the front panel and the top panel includes the line of weakness having an arcuate shape. The fold line between the top panel and the back panel can include one of the fold lines that includes the line of weakness having the arcuate shape. The bottom panel can include a primary bottom panel and a secondary bottom panel. An intermediate bottom panel can be connected between the primary and secondary bottom panels at fold lines. The fold line between the secondary bottom panel and the intermediate bottom panel can include a line of weakness having an arcuate shape. The bottom panel can include a bottom panel support beam formed by first and second bottom angled panels. The first bottom angled panel can be connected to the primary bottom panel at a respective fold line and the second bottom angled panel can be connected to the first bottom angled panel at a support beam fold line. The support beam fold line can include a line of weakness having an arcuate shape.

A shelving unit system, the shelving unit system includes a shelf including a plurality of shelf panels, as described above. The shelving unit system includes a frame configured to engage with at least a portion of the shelf. The frame includes a plurality of frame panels connected together at fold lines, including a back frame panel, first and second side frame panels, and first and second side support panels.

The top shelf panel can include a tab extending therefrom. The back frame panel can include a slot and the tab of the top shelf panel can engage with the slot of the back frame panel. The shelving unit system can include a bottom tray configured to receive a bottom portion of the frame. The bottom tray can include a plurality of panels connected together at fold lines configured for extending at least partially around an interior space, including a bottom tray panel, a front tray panel, a first tray side panel, a back tray panel and a second tray side panel. The shelving unit system can include a bottom filler configured to nest within the bottom tray. The bottom filler can include a plurality of panels connected together at fold lines configured for extending at least partially around an interior space. The plurality of panels of the bottom filler can include a top filler panel, a bottom filler panel, a front filler panel, a first filler side panel, a back filler panel and a second tray side panel.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
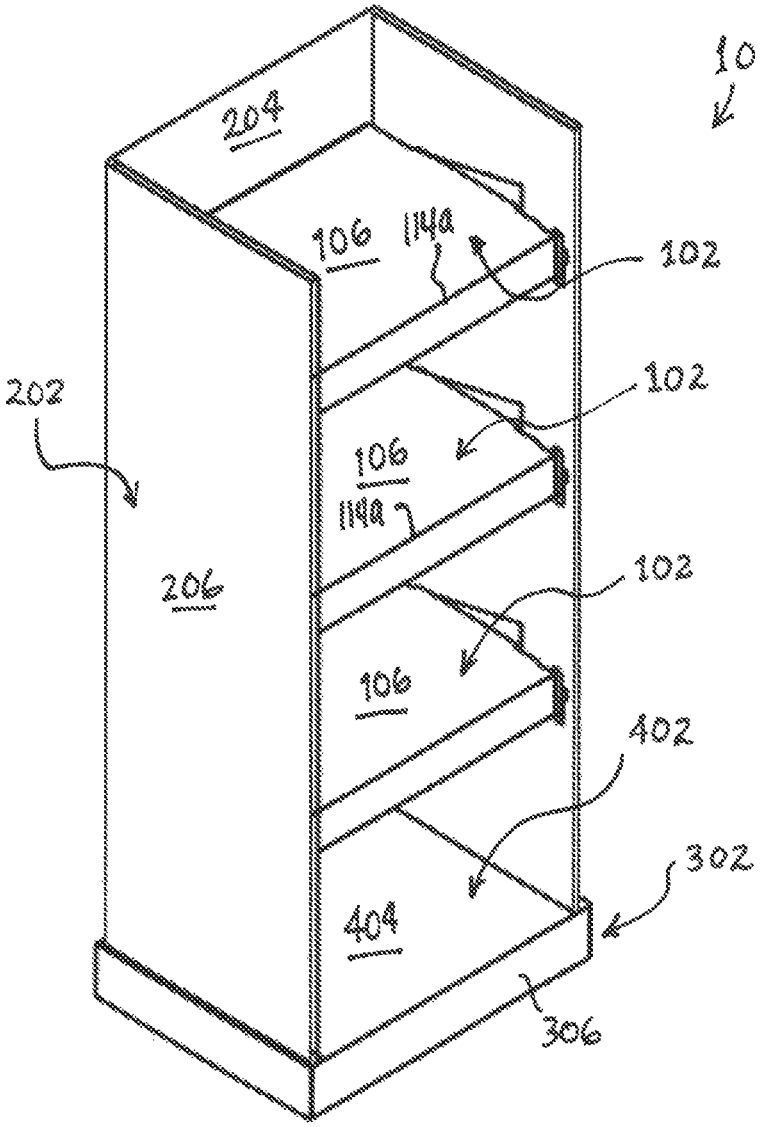
FIG. 1 is a perspective view of an embodiment of a shelving unit system constructed in accordance with the present disclosure, showing the shelf, the frame, the tray and the bottom filler.

Reference will now be made to the drawings wherein like reference numerals identify similar structural features or aspects of the subject disclosure. For purposes of explanation and illustration, and not limitation, a partial view of an exemplary embodiment of a shelf in accordance with the disclosure is shown in FIG. 1 and is designated generally by reference character 100. Other embodiments of containers in accordance with the disclosure, or aspects thereof, are provided in FIGS. 2-26, as will be described. The systems and methods described herein can be used to store product and can also be converted to display product such as in a retail setting.

As shown in FIG. 1, a shelving unit system 10 includes a plurality of shelves 102, a frame 202, a bottom tray 302 and a bottom filler 402. Frame 202 is configured to engage with at least a portion of each shelf 102. Bottom tray 302 is configured to receive a bottom portion of frame 202. Bottom filler 402 is configured to nest within bottom tray 302 and support the bottom of frame 202.

Figure 2:
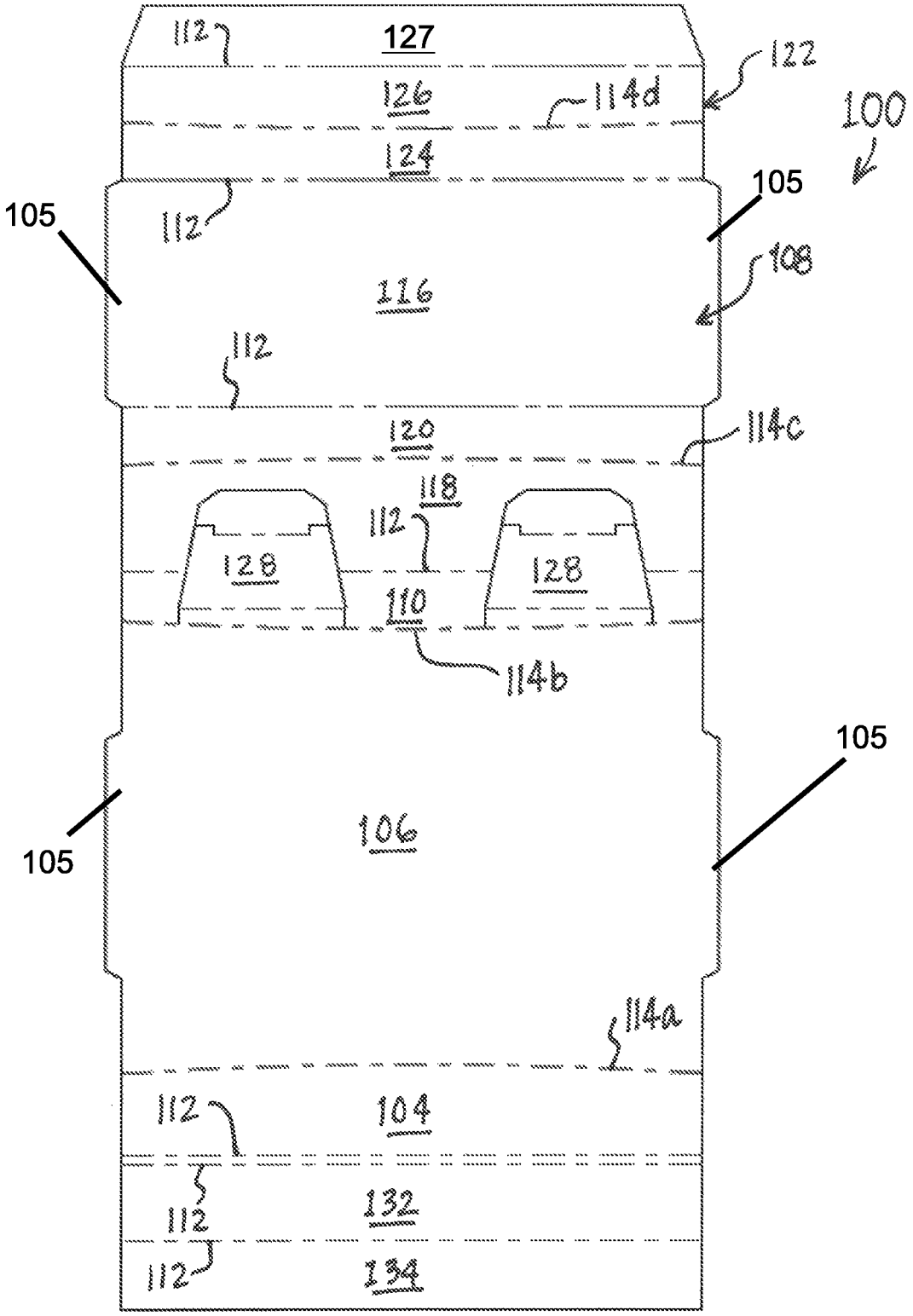
FIG. 2 is a plan view of an embodiment of a blank for a shelf constructed in accordance with the present disclosure, showing a plurality of shelf panels and arcuate fold lines.
Figure 5:
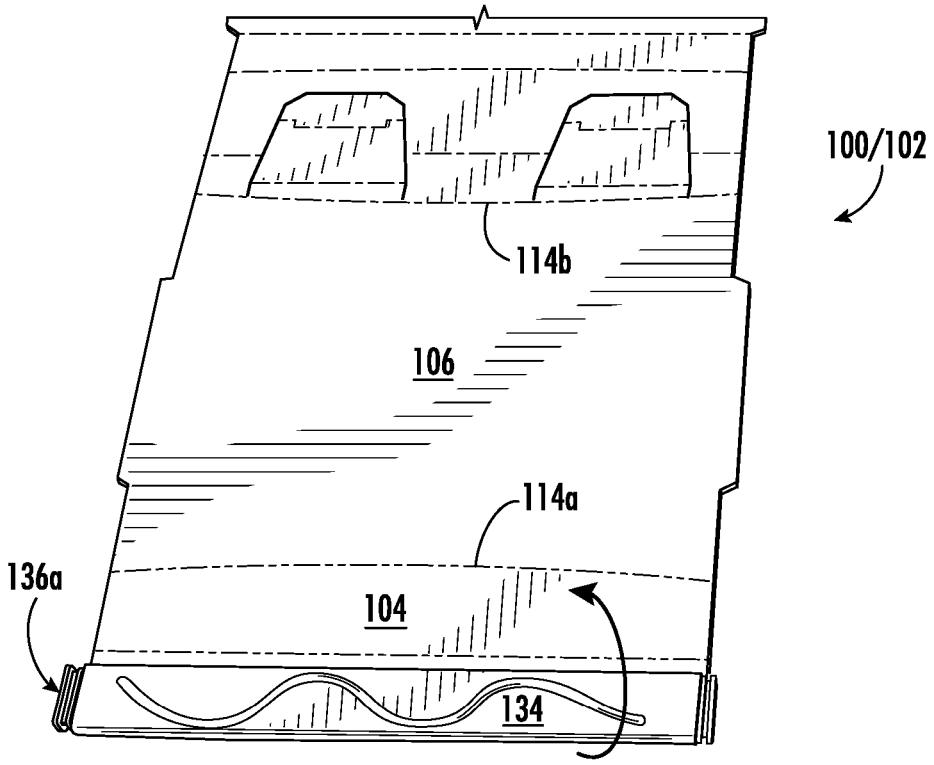
FIG. 5 is a perspective view of a portion of the blank of FIG. 2, showing that the first adhesion panel of the shelf blank was folded onto the second adhesion panel with the shelf clip secured between the two adhesion panels, and showing the first and second adhesion panels are folded about another fold line and are adhered onto the front panel.
Figure 6:
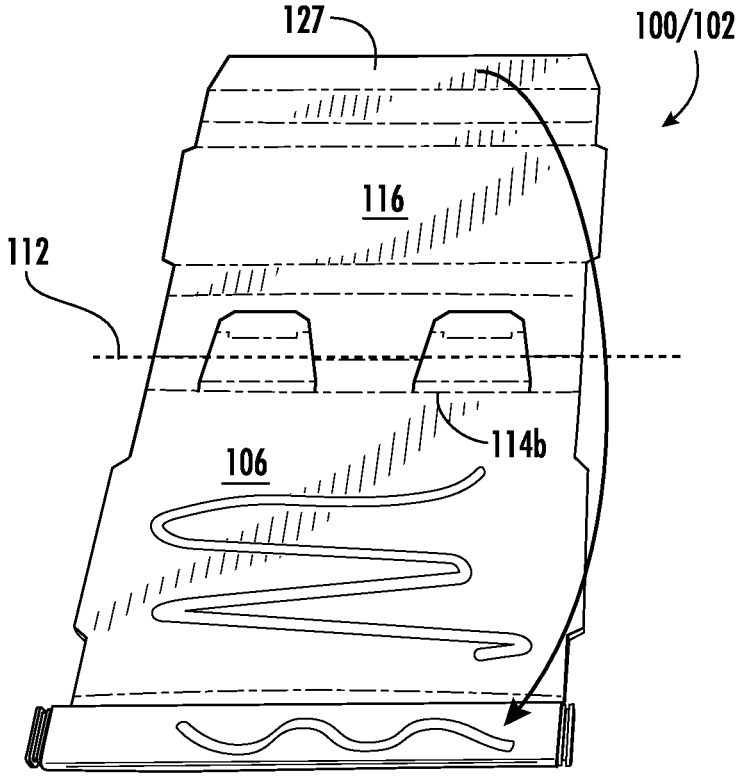
FIG. 6 is a perspective view of a portion of the blank of FIG. 2, showing the blank being folded about a fold line such that a top panel of the blank is adhered to at least a portion of the bottom panel, where the bolded black broken line is shown in an exaggerated schematic manner to identify where the blank is folded.
Figure 7:
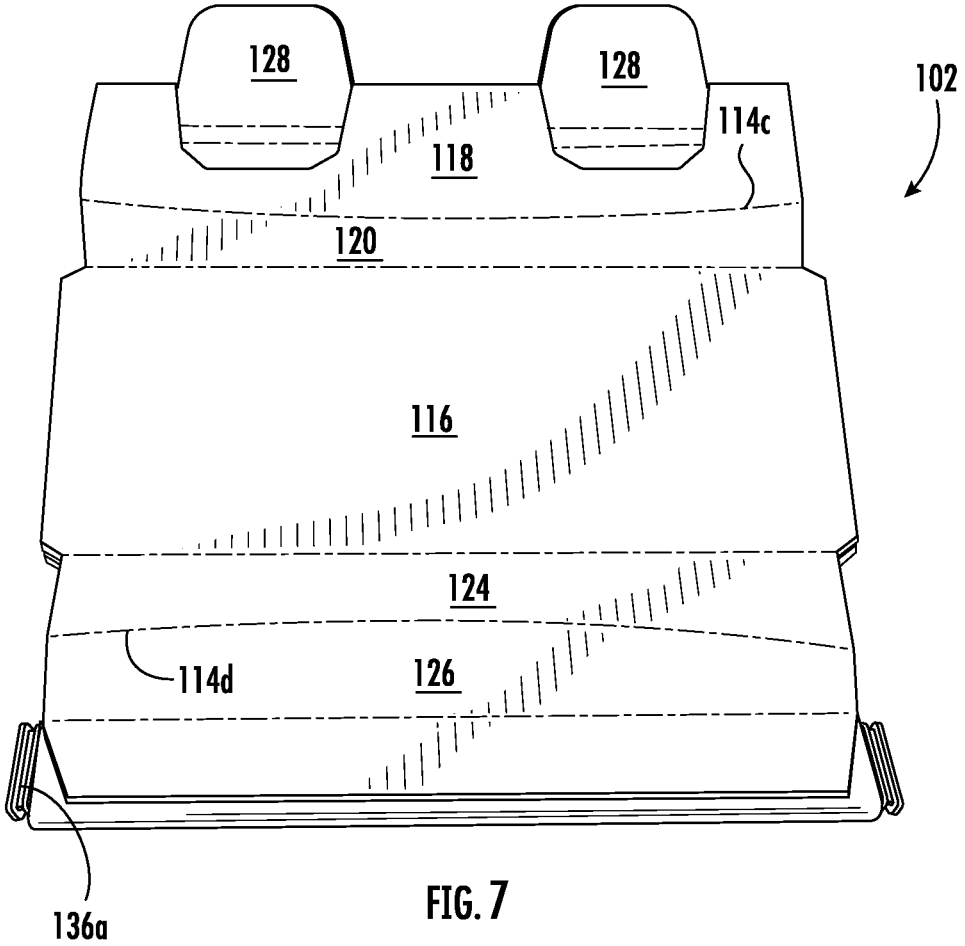
FIG. 7 is a perspective view of an embodiment of a shelf constructed in accordance with the present disclosure formed with the blank of FIG. 2 where the shelf is shown in a flattened position.

With reference now to FIG. 2, a blank 100 for shelf 102 includes a plurality of panels connected together at fold lines 112 and 114*a*-114*d* that are configured to be folded as shown in FIGS. 5-8 to form shelf 102. The plurality of panels includes a front panel 104, a top panel 106, a bottom panel 108 and a back panel 110. Fold lines 114*a*-114*d* each include a line of weakness having an arcuate shape. Each arcuate shape can have a respective radii ranging from 138 inches to 185 inches. Fold line 114*a* between front panel 104 and top panel 106 includes a line of weakness having an arcuate shape, e.g. having a radius of curvature of about 138 inches. Fold line 114*b* between top panel 106 and back panel 110 includes a line of weakness having an arcuate shape, e.g. having a radius of curvature of about 152 inches. When folded into shelf 102, as shown in FIG. 7, arcuate fold lines 114*a* and 114*b* form arcuate edges on the front and back sides of top panel 106 such that the arcuate edge is arranged with the convex side in the upward direction, as oriented in FIGS. 25-26. These arcuate edges lift the top panel 106, and the bottom panel 108 that is adhered thereto, slightly upward. This upward lift can create an upward bowing in at least a portion of panels 106 and 116 in a similar direction as the arcuate edge of fold line 114*a*. The arcuate edges at fold lines 114*a* and 114*b* and/or the bowed panels 106 and 116 provide extra support on shelf and reduces the tendency to sag when heavy weight is being supported on shelf 102 and provides a more sturdy shelf platform (e.g. the platform formed by top panel and bottom panel 108). It also allows the shelf platform to support heavier products with a reduced amount of material, which tends to reduce waste.

With continued reference to FIG. 2, blank 100 includes tabs 128 extending from the top panel 106. Each tab 128 is cut from back panel 110 and bottom panel 108. Bottom panel 108 includes a primary bottom panel 116 and a secondary bottom panel 118. An intermediate bottom panel 120 is connected between primary and secondary bottom panels 116 and 118, respectively, at fold lines 112 and 114*c*. Fold line 114*c* between secondary bottom panel 118 and intermediate bottom panel 120 includes a line of weakness having an arcuate shape, e.g. a radius of curvature of about 184 inches. Bottom panel 108 includes a bottom panel support beam 122 formed by first and second bottom angled panels 124 and 126, respectively. Support beam 122 reinforces top panel 106. First bottom angled panel 124 is connected to primary bottom panel 116 at a respective fold line 112 and second bottom angled panel 126 is connected to first bottom angled panel 124 at a support beam fold line 114*d*. Support beam fold line 114*d* is a line of weakness having an arcuate shape, e.g. a radius of curvature of about 184 inches. The dimensions provided herein are only for example and those skilled in the art will readily appreciate that a larger or smaller radius of curvature may be used for any of fold lines 114*a*-114*d*.

Figure 3:
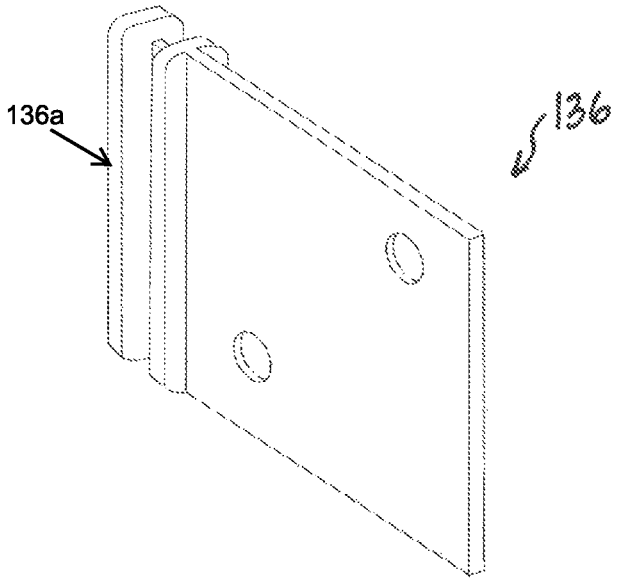
FIG. 3 is a perspective view of an embodiment of a shelf clip constructed in accordance with the present disclosure.
Figure 4:
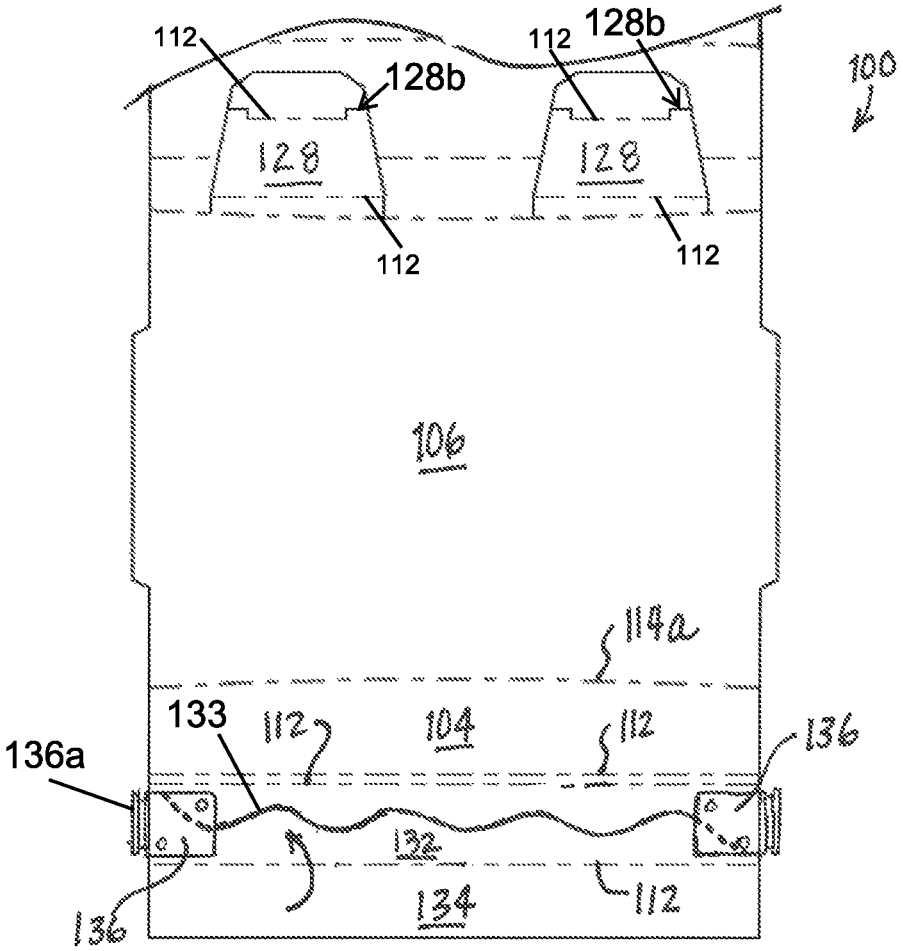
FIG. 4 is a plan view of a portion of the blank of FIG. 2, showing the shelf clip adhered to a panel of the shelf blank and schematically showing how the first adhesion panel of the shelf blank is folded about the fold line onto the second adhesion panel to form the shelf.

As shown in FIGS. 2-7, blank 100 includes two front adhesion panels 132 and 134. A first one 132 of the two front adhesion panels 132 and 134 is connected to front panel 104 at spaced apart fold lines 112. A second one 134 of the two front adhesion panels 132 and 134 is connected to first front adhesion panel 132 at an adhesion panel fold line 112. As shown in FIG. 3, shelf 102 formed from blank 100 includes a shelf clip 136 adhered to front adhesion panel 132. A method of forming shelf 102 includes making blank 100 and applying adhesive to adhesion panel 132 and/or clip 136. FIG. 4 shows this schematically by the wavy line 133 running across front adhesion panel 132, this includes adhesive underneath shelf clip 136. It is contemplated that adhesive can be applied on top of shelf clip 136 as well. The method for forming shelf 102, second adhesion panel 134 is folded about the fold line 112 onto first adhesion panel 132 to abut an inner surface of first adhesion panel 132 and to secure shelf clip 136 therebetween, this is shown schematically in FIG. 4 by the arrow. A portion of clip 136*a* protrudes outward from panels 132 and 134 and is configured to engage with a portion of frame 202, as will be described below.

As shown in FIGS. 4-6, the method for forming shelf includes folding first and second adhesion panels 132 and 134, respectively, about another fold line 112 and adhering them to a back side of front panel 104. This folding is shown schematically by the arrow of FIG. 5. The method for forming shelf 102 from blank 100 includes folding blank 100 about fold line 112 between back panel 110 and secondary bottom panel 118 such that top panel 106 of the blank is adhered to at least primary bottom panel 116. This is shown schematically in FIG. 6, where fold line 112 between back panel 110 and secondary bottom panel 118 is shown in an exaggerated bolded black broken line. As shown in FIG. 6, surface "b" designating an inner surface of primary bottom panel 116 is adhered to surface "b" opposite from primary bottom panel 116, which is an inner surface of top panel 106. Surface "a" designates an inner surface of an adhesion flap 127 and the other surface "a" opposite from the adhesion flap across fold line 112 is designating an outer surface of second front adhesion panel 134.

Figure 8:
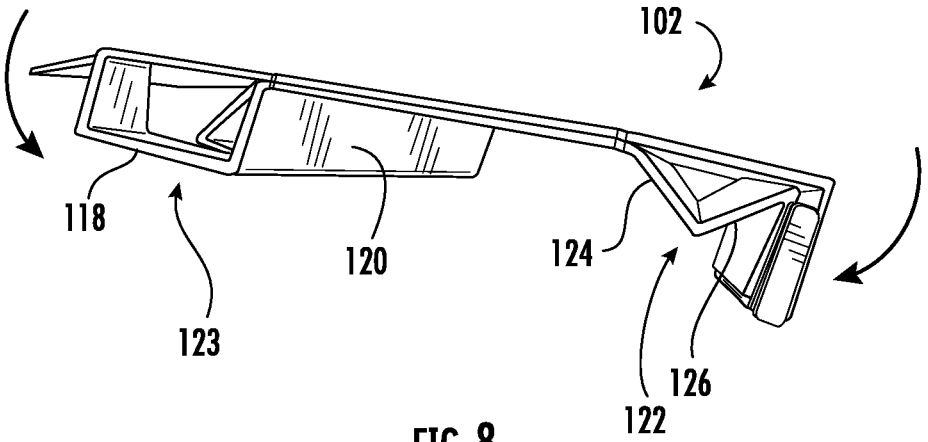
FIG. 8 is a perspective view of the shelf of FIG. 7 in an erected position.
Figure 25:
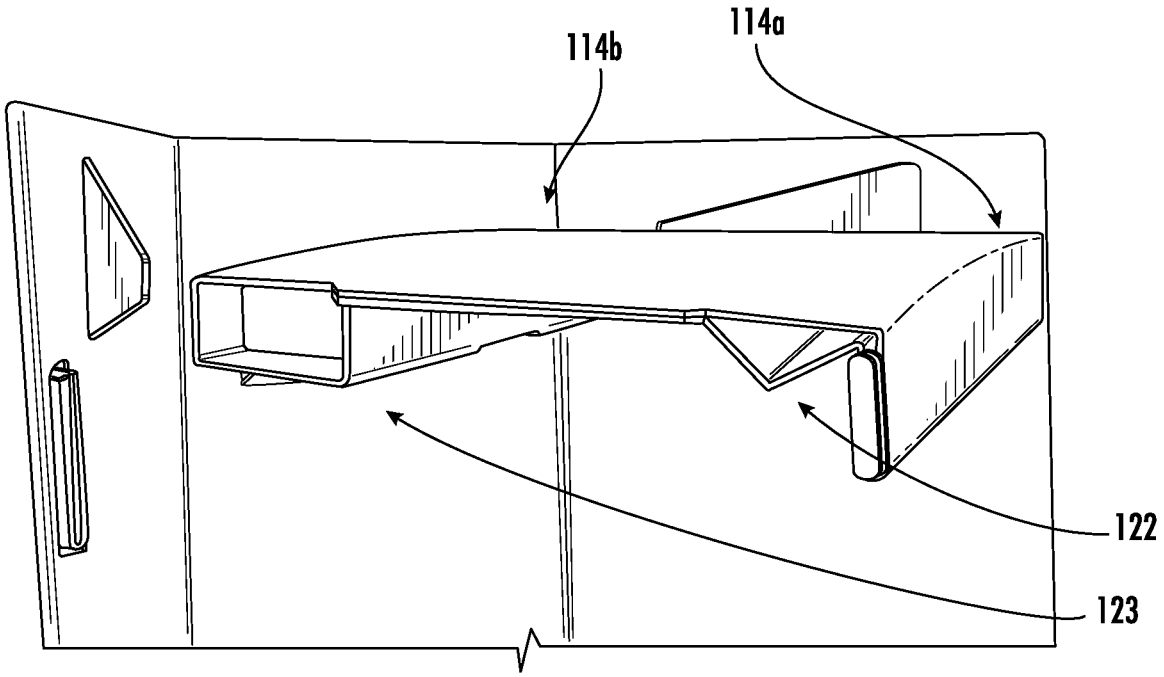
FIG. 25 is a perspective view of the shelf of FIG. 7 in an erected position partially assembled into a frame, schematically showing the arcuate edges of the shelf.

With reference now to FIG. 7, shelf 102 is shown in its assembled position in a flattened state. As shown in FIGS. 8 and 25, the shelf 102 is erected and bottom panel support beam 122 formed by first and second bottom angled panels 124 and 126, respectively, projects outward from primary bottom panel 116 to reinforce primary bottom panel 116 and top panel 106. Similarly, a second bottom panel support beam 123 formed by secondary bottom panel 118 secondary bottom panel 120 and back panel 110 projects outwards relative to the primary bottom panel 116. Arcuate shaped fold line 114*c* generates an arcuate edge between secondary bottom panel 118 and intermediate bottom panel 120 that acts to push primary bottom panel 116 and top panel 106 in an upward direction, as oriented in FIG. 25. The arcuate edge formed by arcuate fold line 114*c* is arranged with the convex side toward panel 120 in the upward direction, as oriented in FIGS. 25-26. The arcuate shape of support beam fold line 114*d* generates an arcuate edge between angled panels 124 and 126 that also pushes primary bottom panel 116 and top panel 106 in the upward direction. The arcuate edge formed by arcuate fold line 114*d* is arranged with the convex side toward panel 124. The arcuate edges formed at fold lines 114*c*-114*d* can also support the upward bowing of at least portions of panels 116 and 106. Those skilled in the art will readily appreciate that the upward bowing of panels 106 and 116 supported by fold lines 114*a*-114*d* may not exist, or may not be visible, in all embodiments depending on the type of materials used to form blank 100.

Figure 26:
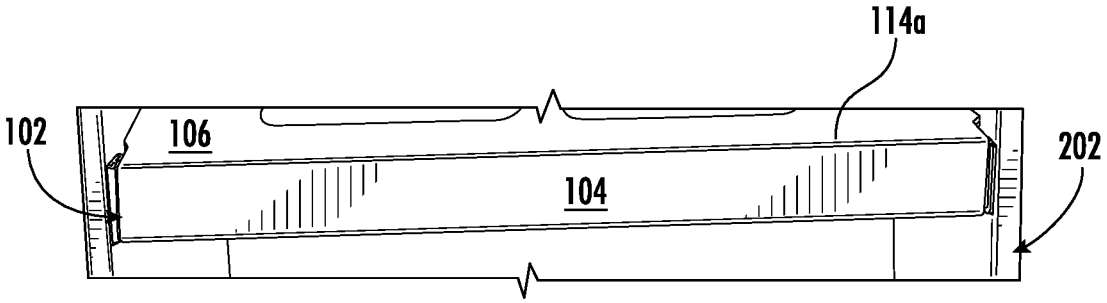
FIG. 26 is a front perspective view of the shelf of FIG. 7 in an erected position assembled into a frame, showing a front arcuate edge of the shelf.

FIG. 25 shows shelf 102 positioned partially with a frame 102 and shows the curvature of the edges formed at fold lines 114*a* and 114*b*. The arcuate edges are overlaid with a dashed line for clarity so that the arcuate shape is appreciated. FIG. 26 shows shelf 102 positioned within frame 202 from a front side. In this view, the arcuate edge formed at fold line 114*a* between front panel 104 and top panel 106 is visibly noticeable. Those skilled in the art will readily appreciate that when items are stored on top of shelf 102, the arcuate edges at one or more of fold lines 114*a*-114*d* may flatten out and not be as readily visible, or it may entirely flatten out depending on the weight of the products. Those skilled in the art will readily appreciate that, in some embodiments, regardless of the weight of the products, an arcuate edge on shelf 102 at any of fold lines 114*a*-114*d* may not be visible depending on the type of materials used to form blank 100.

In FIGS. 7 and 8, inner surfaces of the top panel 106 and the primary bottom panel 116 are adhered to one another to form shelf 102. At any given point along top panel 106, there are two panel layers (e.g. top panel and primary bottom panel). Even with only two panel layers making up the portion of shelf 102 that supports a product, because of arcuate fold lines described above, shelf 102 can still withstand the same or more amount of weight that of a conventional shelf style, e.g. one that has more than two layers of material. This reduces the amount of material required for shelf 102, while still meeting weight capacity requirements. It also can reduce the gluing/adhesion steps required, which can save time and increase efficiency. Tabs 128 extend outward from top panel 106 of shelf 102 for engaging with frame 202, described below.

Figure 9:
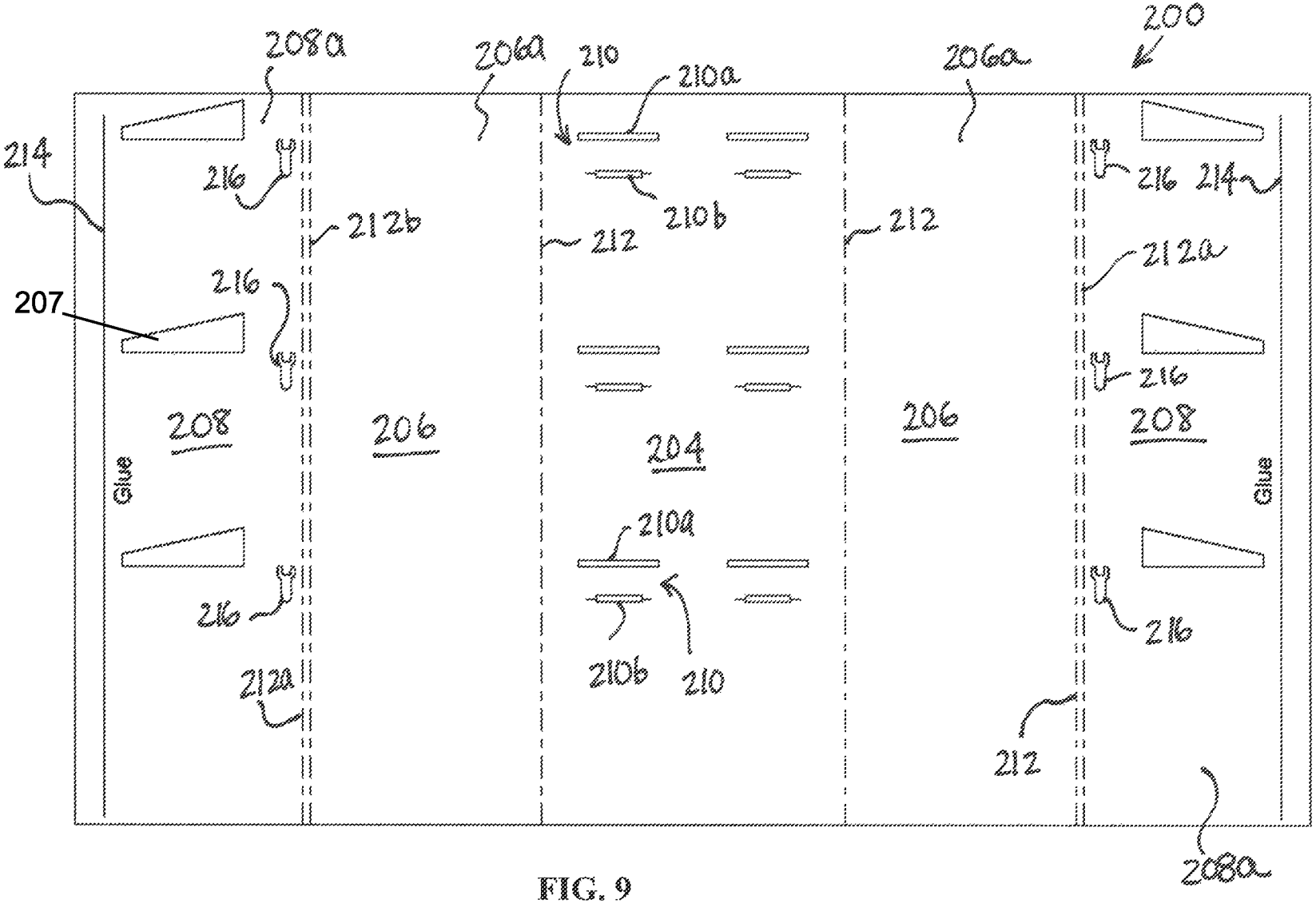
FIG. 9 is a plan view of an embodiment of a frame blank constructed in accordance with the present disclosure for forming a frame, showing a plurality of frame panels connected together at fold lines.
Figure 10:
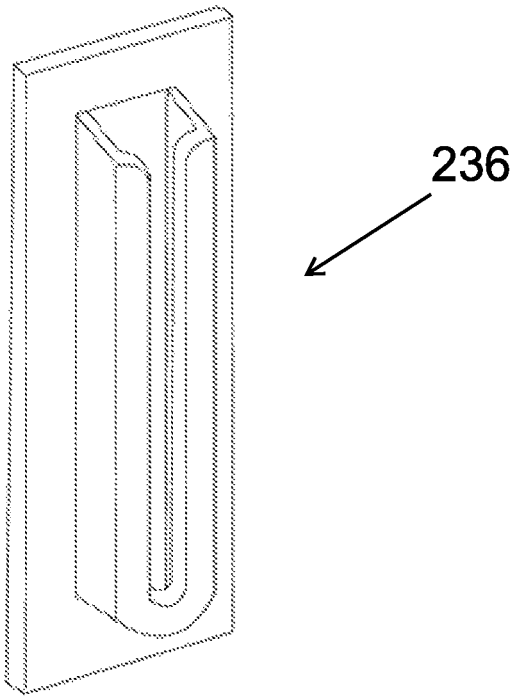
FIG. 10 is a perspective view of an embodiment of a support clip track constructed in accordance with embodiments of the present disclosure.
Figure 11A:
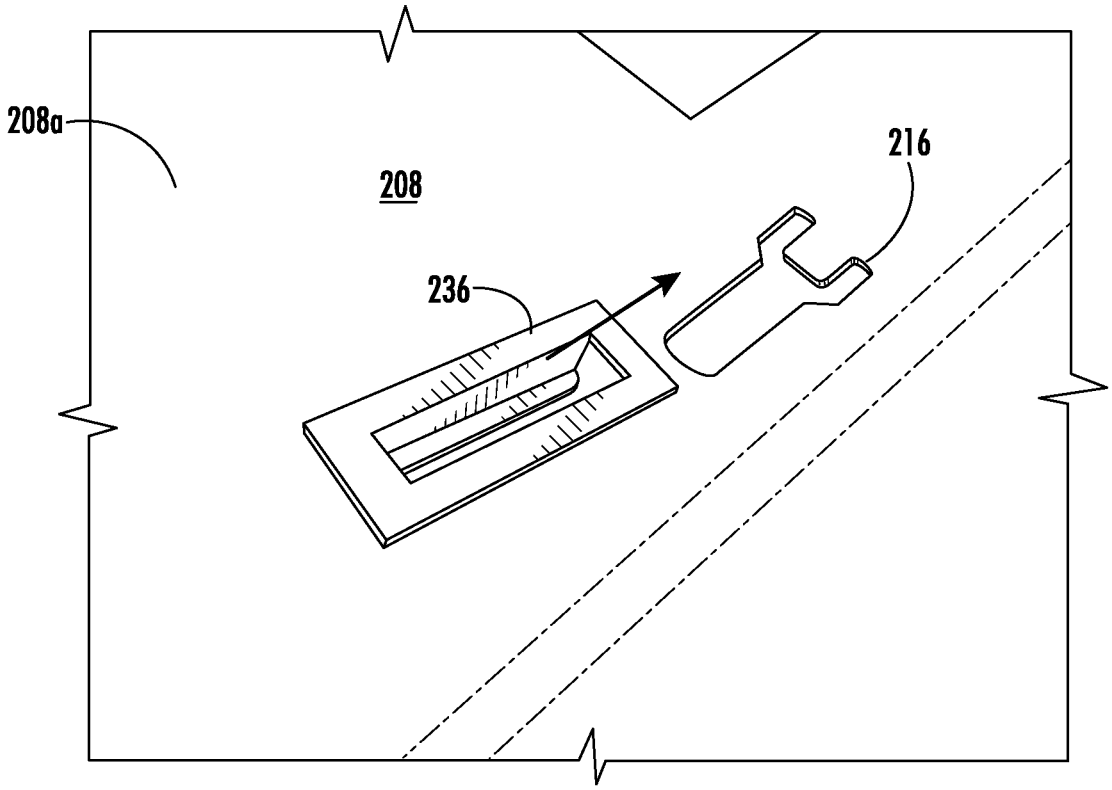
FIGS. 11A-11B are perspective views of a portion of the blank of FIG. 9, showing the support clip track of FIG. 10 being inserted (FIG. 11A) and secured (FIG. 11B) into a clip cut-out on the frame blank.
Figure 11B:
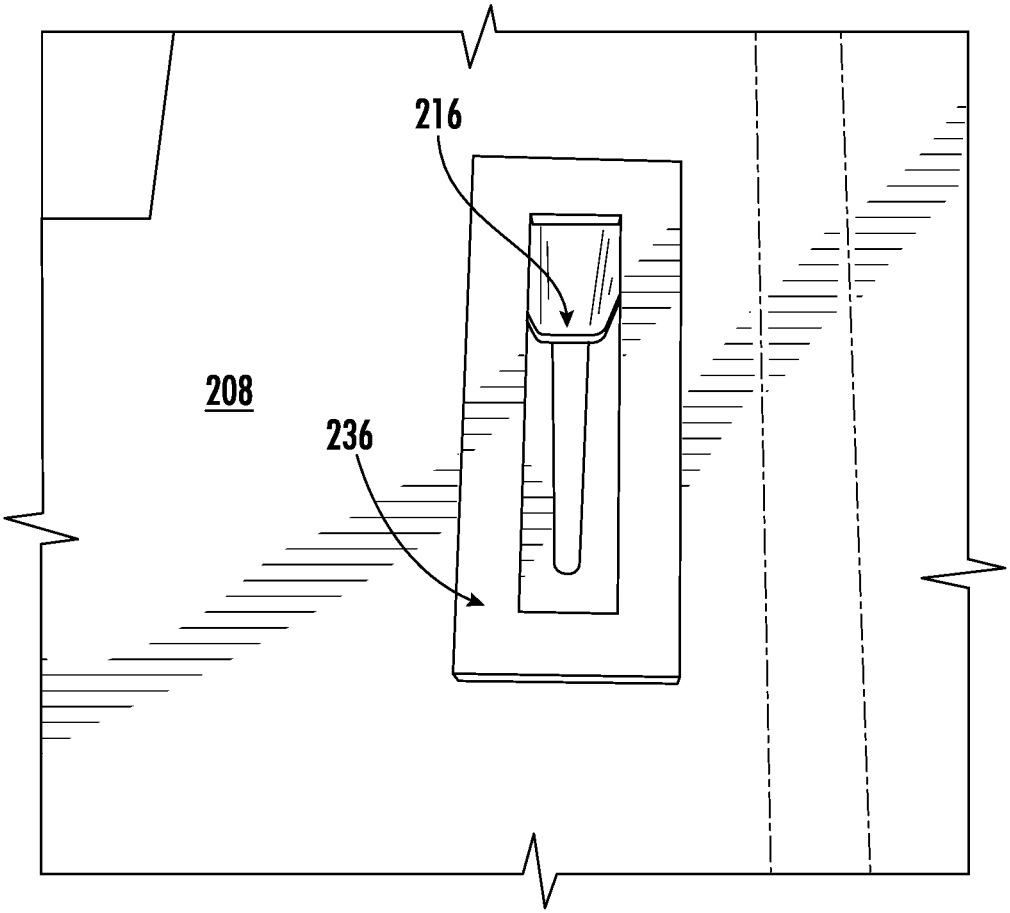
Figure 12:
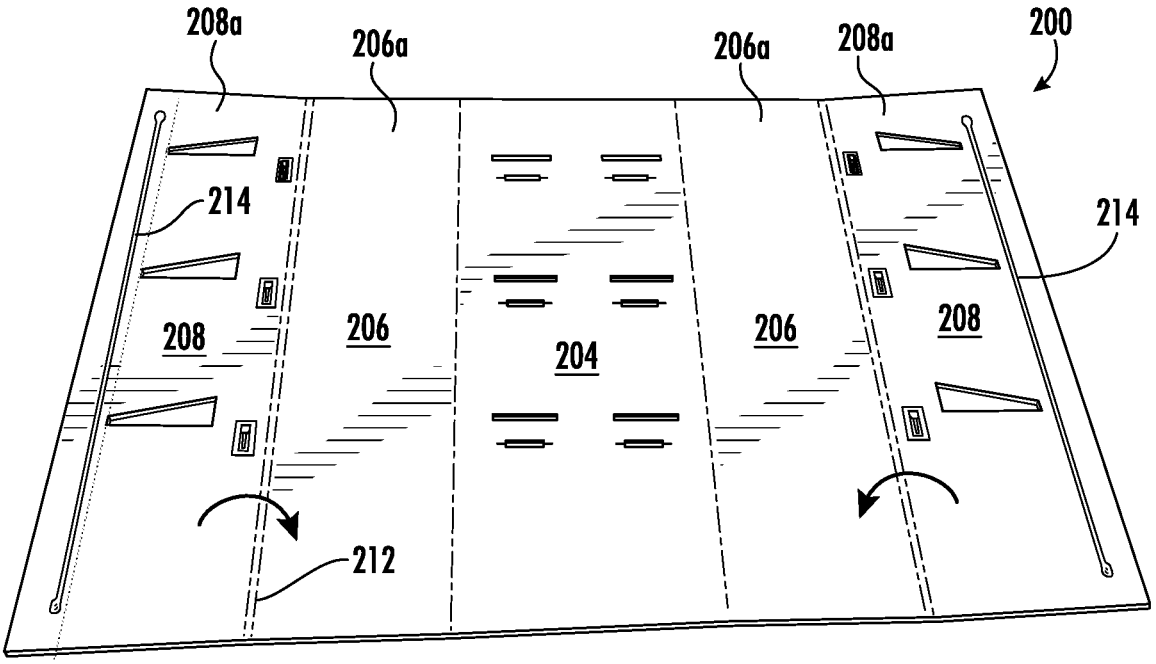
FIG. 12 is a perspective view of the frame blank of FIG. 9, showing the side support panels being folded inward and being secured to their respective side frame panels to form the frame.
Figure 13:
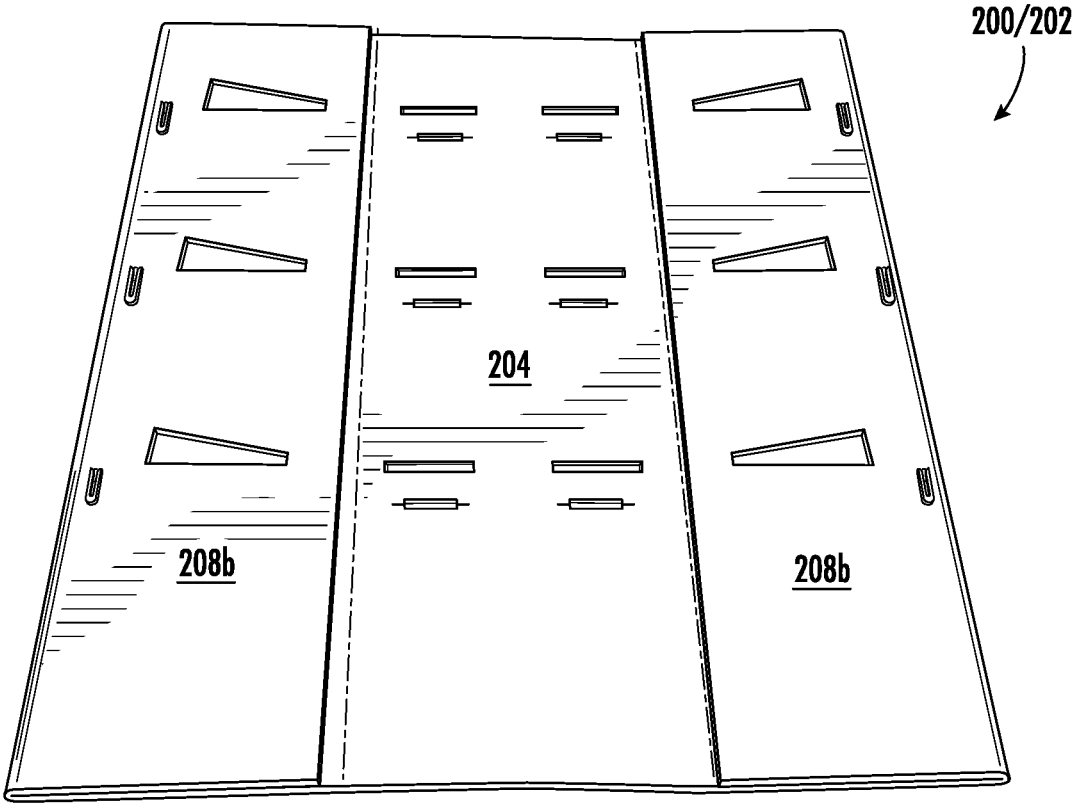
FIG. 13 is a perspective view of an embodiment of a frame constructed in accordance with the present disclosure formed from the frame blank of FIG. 9, showing the side support panels folded inward.

A blank 200 for frame 202 includes a plurality of frame panels connected together at fold lines 212. Blank 200/frame 202 includes a back frame panel 204, first and second side frame panels 206, and first and second side support panels 208. Back frame panel 204 includes pairs of slots 210 for receiving tabs 128 of each shelf 102. Each pair of slots 210 includes a top slot 210*a* and a bottom slot 210*b*. As shown in FIGS. 10-11B, to form blank 200 into frame 202, support clip tracks 236 are inserted and secured into respective clip cut-outs 216. As schematically shown in FIGS. 9 and 12, a glue or adhesive line 214 is applied to an inner surface 208*a* of each of side support panel 208 so that, once folded, inner surface 208*a* of each side support panel 208 adheres to an inner surface 206*a* of its respective side frame panel 206. After glue or adhesive line 214 is applied, first and second side support panels 208 are folded inward toward their respective first and second side frame panels 206 about their respective fold lines 212*a*, as indicated schematically by the arrows in FIG. 12. FIG. 13, shows frame 202 after assembly of blank 200, where an outer surface 208*b* of each side support panel 208 is visible.

Figure 14:
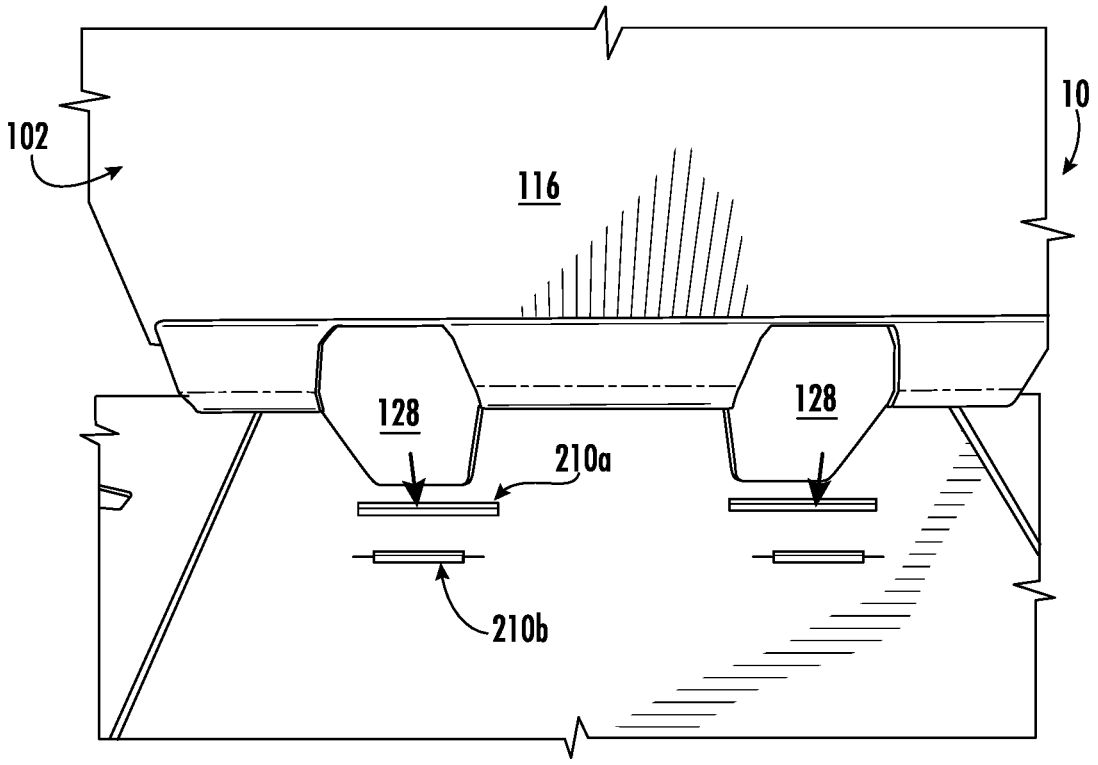
FIG. 14 is a perspective view of the frame of FIG. 13 and the shelf of FIG. 7, showing the tabs of the shelf engaging with two first slots of the back frame panel.
Figure 15:
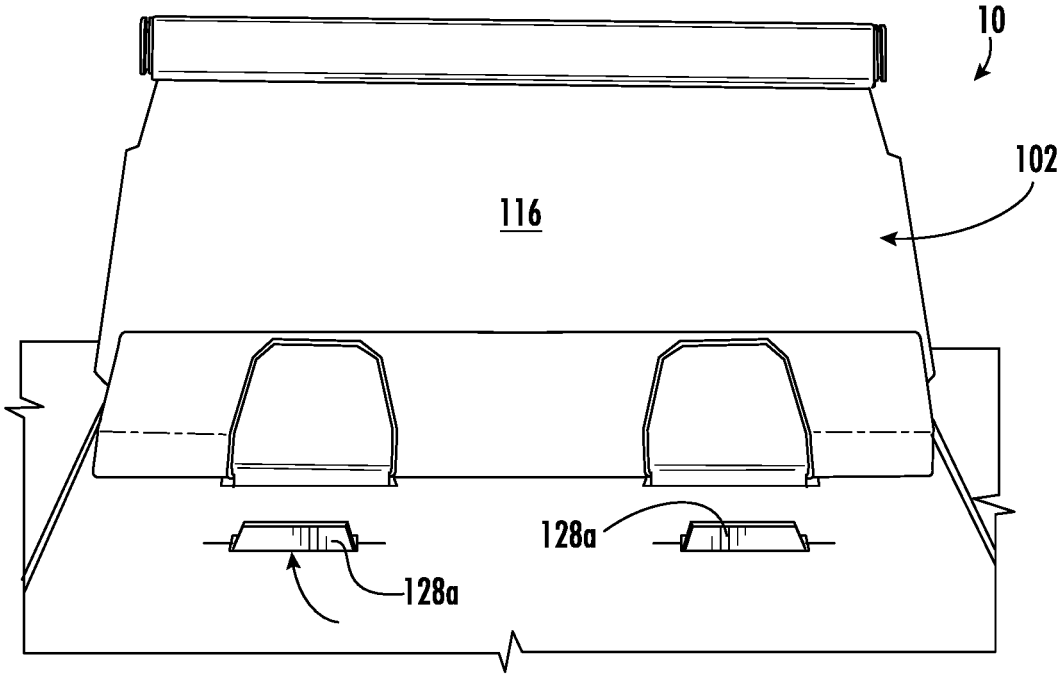
FIG. 15 is a perspective view of the frame of FIG. 13 and the shelf of FIG. 7, showing the tabs of the shelf threaded under the back frame panel and up through two second slots of the back frame panel.
Figure 16A:
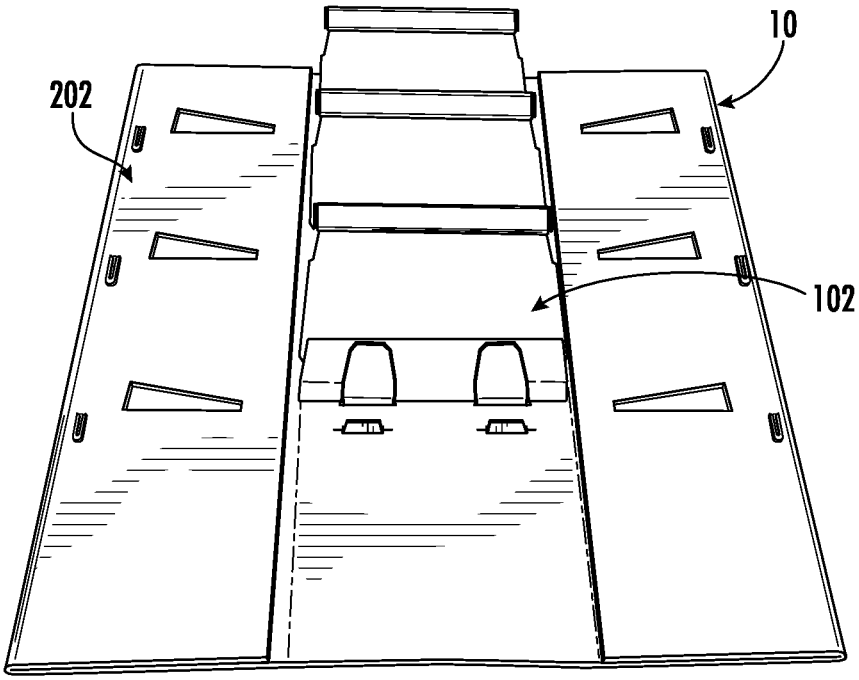
FIG. 16A is a perspective view of the frame of FIG. 13 and the shelf of FIG. 7, showing three shelves engaged with the back frame panel of the frame forming a portion of the shelving unit of FIG. 1.
Figure 16B:
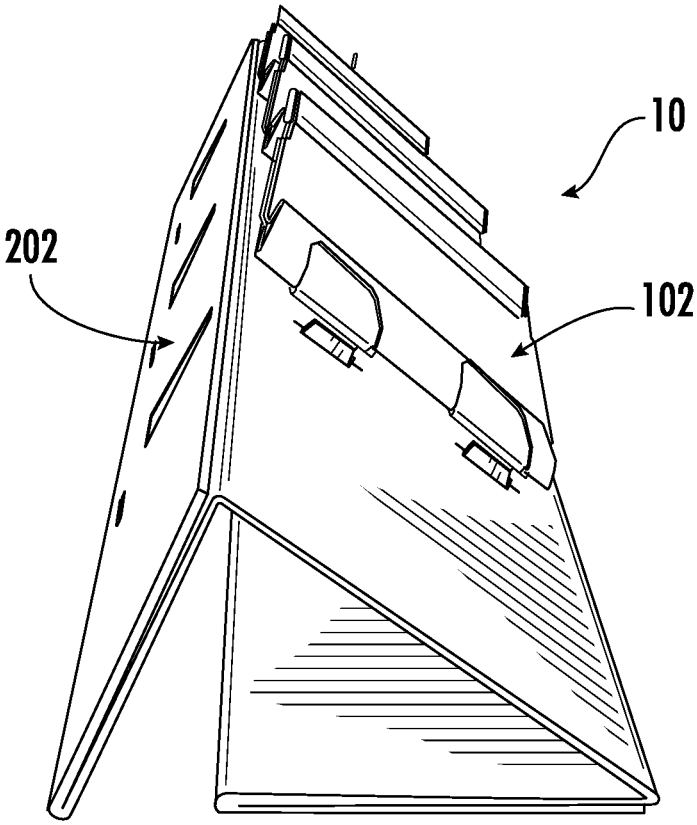
FIG. 16B is a perspective view of the frame of FIG. 13 and the shelf of FIG. 7, showing the side support panels and their respective side frame panels being folded back toward a side of the back frame panel opposite from the shelves.
Figure 16C:
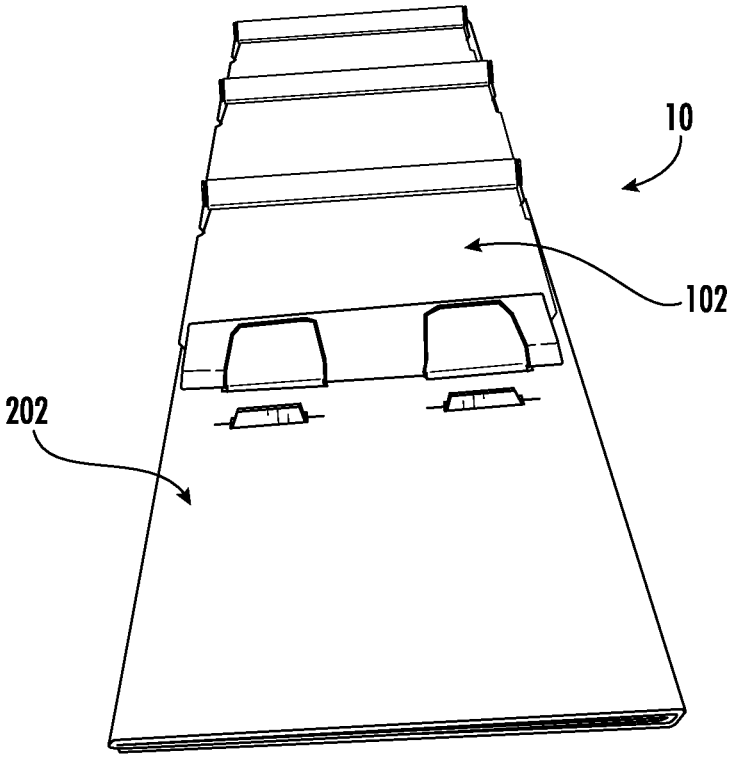
FIG. 16C is a perspective view of the frame of FIG. 13 and the shelf of FIG. 7, a portion of the shelving unit of FIG. 1 in a folded shipping configuration.

As shown in FIGS. 14-15, once frame 202 and shelves 102 are formed, each shelf 102 can be engaged with slots 210 of back panel 204 by using tabs 128 of shelves 102. As shown in FIG. 14, each tab 128 threaded into a first slot 210*a*, underneath back panel 204 and then back up through slot 210*b*. A tip portion 128*a* of tab 128 projects outward from back panel 204 and is retained in back panel due to side cuts 128*b* between tip portion 128*a* and the rest of tab 128, labeled in FIG. 2. FIGS. 16A-16C, show a portion of shelving unit 10 assembled (frame 202 and shelves 102). For compact shipping, the side panels 206 and 208 of frame 202 can be folded backward.

Figure 17:
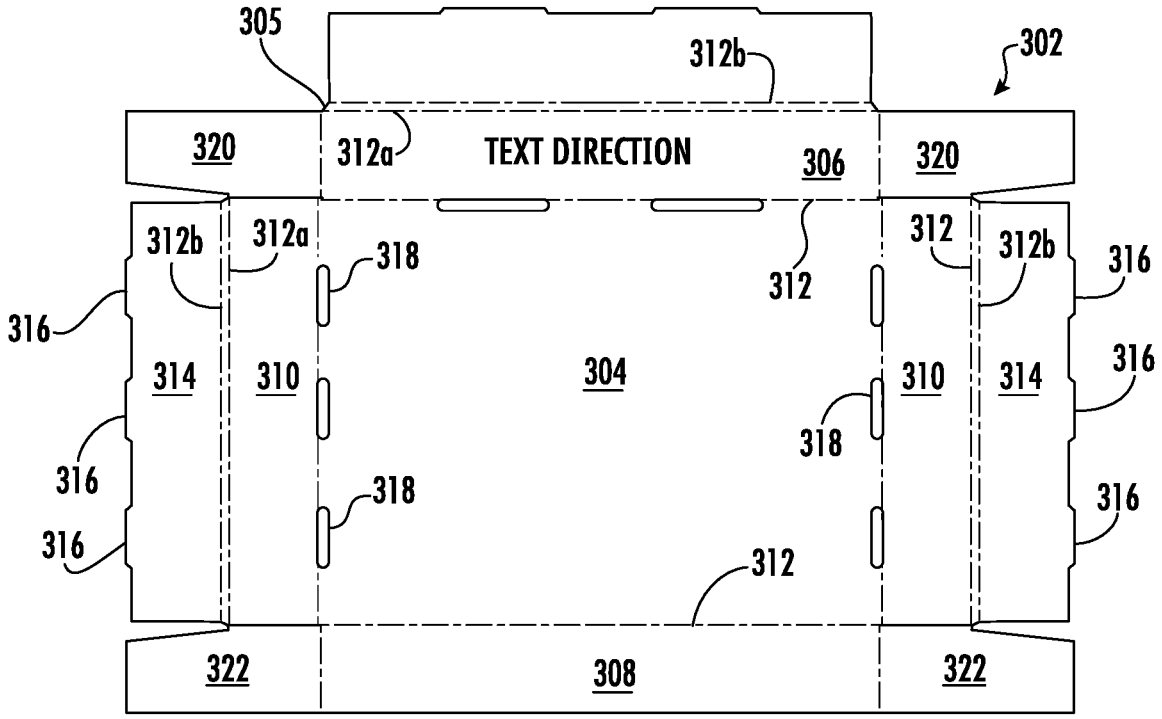
FIG. 17 is a plan view of an embodiment of a blank for a bottom tray constructed in accordance with the present disclosure, showing a plurality of tray panels connected to one another at a plurality of respective fold lines.
Figure 18A:
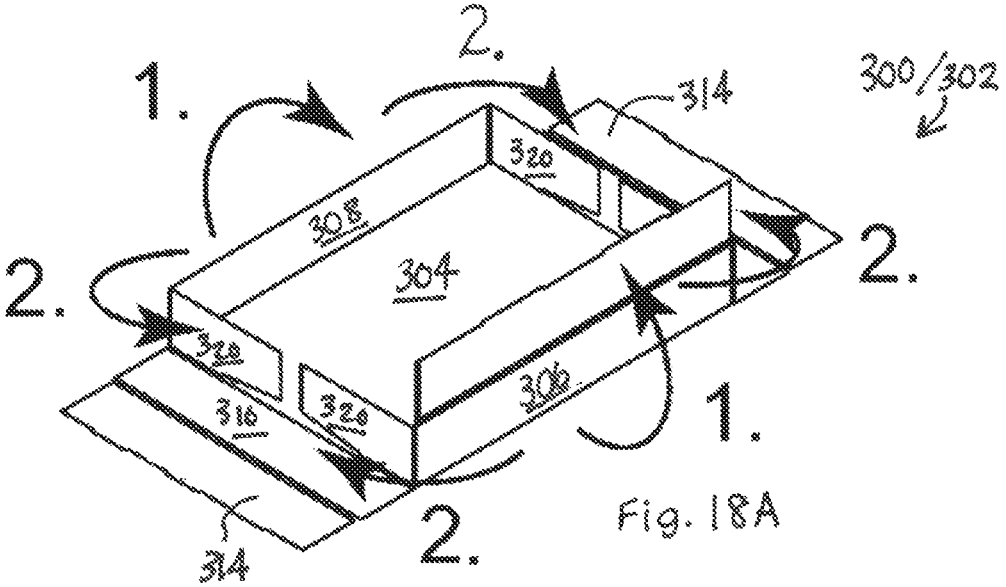
FIGS. 18A-18B are perspective views of an embodiment of the bottom tray constructed in accordance with the present disclosure being formed with the blank of FIG. 17, showing folding steps schematically with numbered arrows.
Figure 18B:
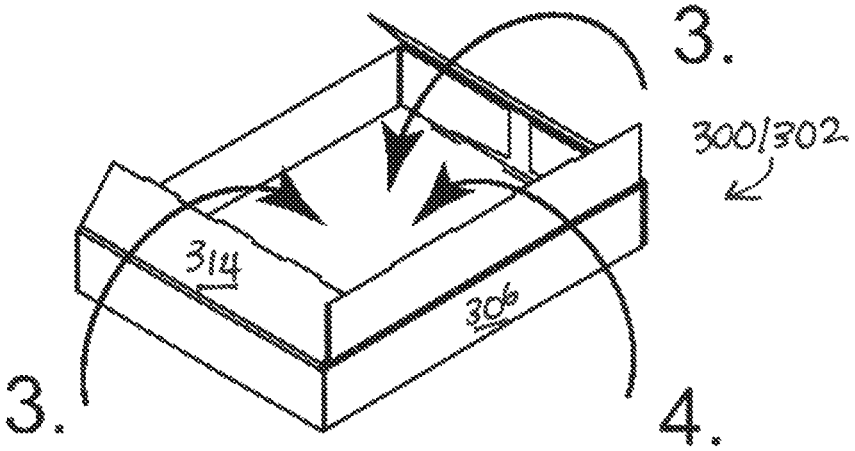
Figure 18C:
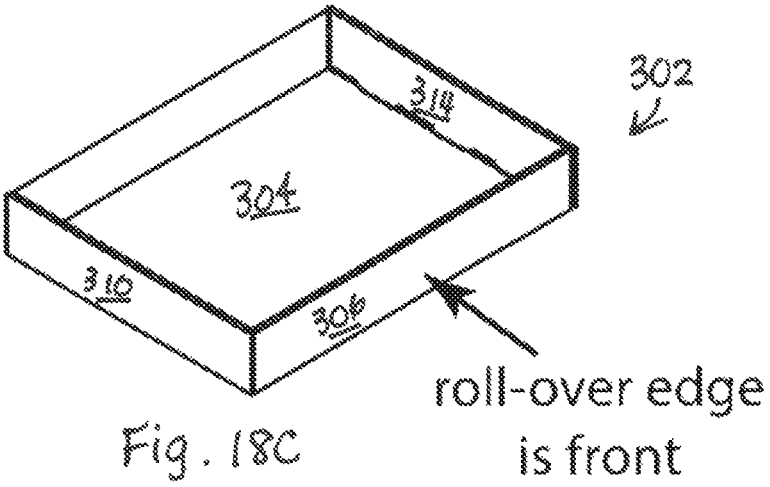
FIG. 18C is a perspective view of an embodiment of the bottom tray constructed in accordance with the present disclosure.

With reference now to FIG. 17, a blank 300 for forming the bottom tray 302 includes a plurality of panels connected together at fold lines configured for extending at least partially around an interior space, including a bottom tray panel 304, a front tray panel 306, a back tray panel 308 and first and second tray side panels 310. Each tray side panel 310 includes a respective side flap 312. Front tray panel 306, when assembled into shelving unit 10, is in the front of unit 10 and therefore, in some embodiments, it may be desired to have text or graphics included on panel 306. The direction of the text is indicated by the "text direction" marking. Tray 302 is formed with the blank 300 by folding as shown in FIGS. 18A-18C. An embodiment of a method for folding is showing schematically by numbered arrows.

In FIG. 18A, front and back panels 306 and 308 are folded with respect to bottom tray panel 304 and flaps 320 are folded inward. Blank 300 is formed with a cut between end flaps 320 and the adjacent tray side panels 310 so that end flaps 320 can be folded inward as shown in FIG. 18A. As shown in FIG. 18B, a method for folding blank 300 include folding each side flap 314 inward toward its respective side panel 310 about fold lines 312*a* and 312*b*. Each side flap 314 includes projections 316 that engage with slots 318 in bottom tray panel 304 in order to secure a given flap 314 and its associated tray side panel 310 in an upright position. Bottom tray 302 is shown assembled in FIG. 18C.

Figure 19:
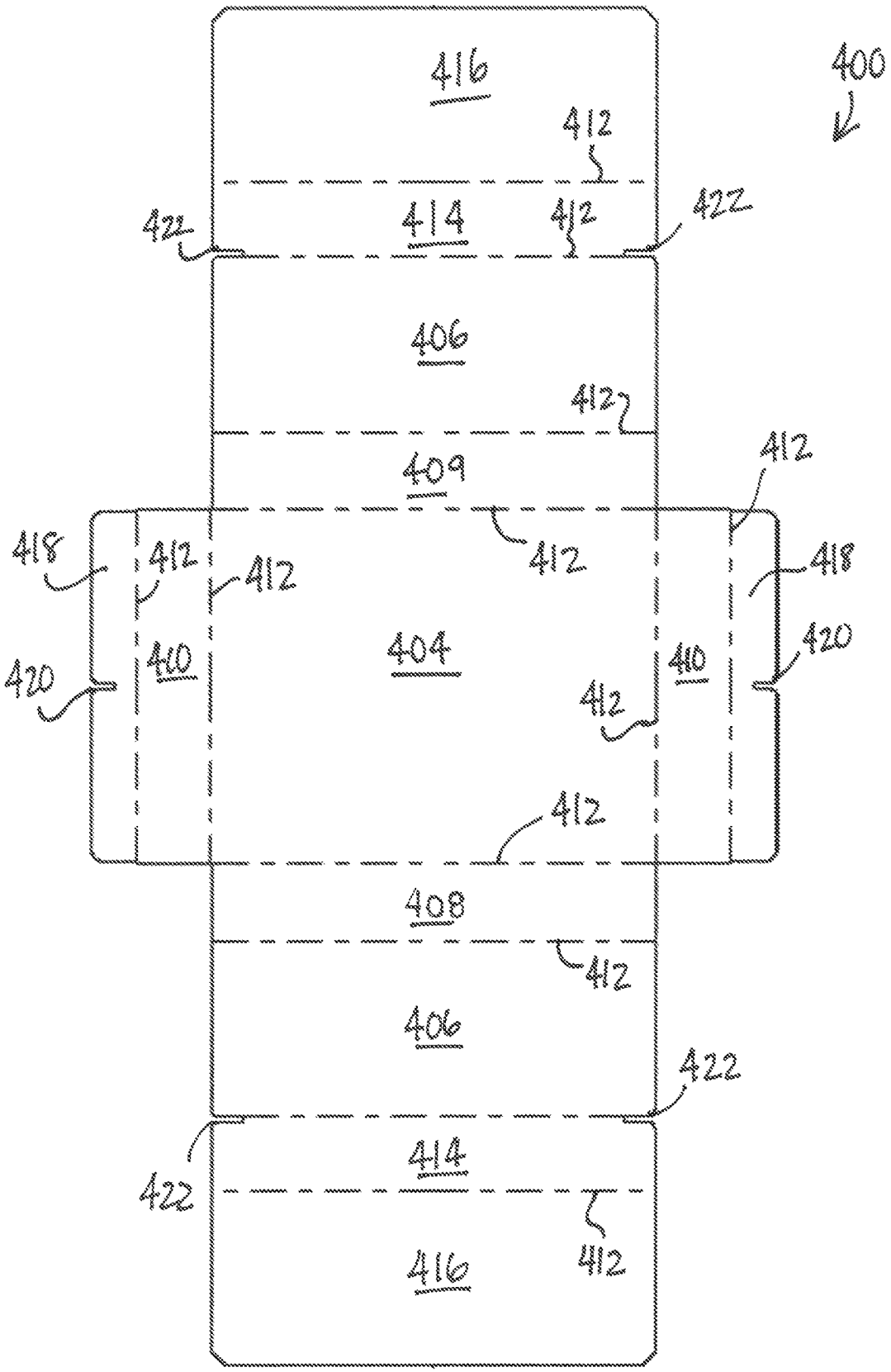
FIG. 19 is a plan view of an embodiment of a blank for a bottom filler constructed in accordance with the present disclosure, showing a plurality of bottom filler panels connected to one another at a plurality of respective fold lines.

With reference now to FIG. 19, bottom filler 402 is formed from a bottom filler blank 400. Bottom filler blank/bottom filler 400/402 includes a plurality of panels connected together at fold lines 412 configured for extending at least partially around an interior space. The plurality of panels of the bottom filler blank 400 includes bottom filler panels 406, a top filler panel 404, a front filler panel 408, a back filler panel 409 and filler side panels 410. Each filler side panel 410 includes a respective securing flap 418 having a slot 420. Front filler panel 408 includes a support flap having a side support panel 414 and a bottom support panel 416. Side support panel is connected to front filler panel at a respective fold line 412 and bottom support panel 416 is connected to side support panel 414 at a respective fold line 412. A pair of securing slots 422 are positioned on each end of the side support panel 414, between the bottom panel 406 and the side support panel.

Figure 20A:
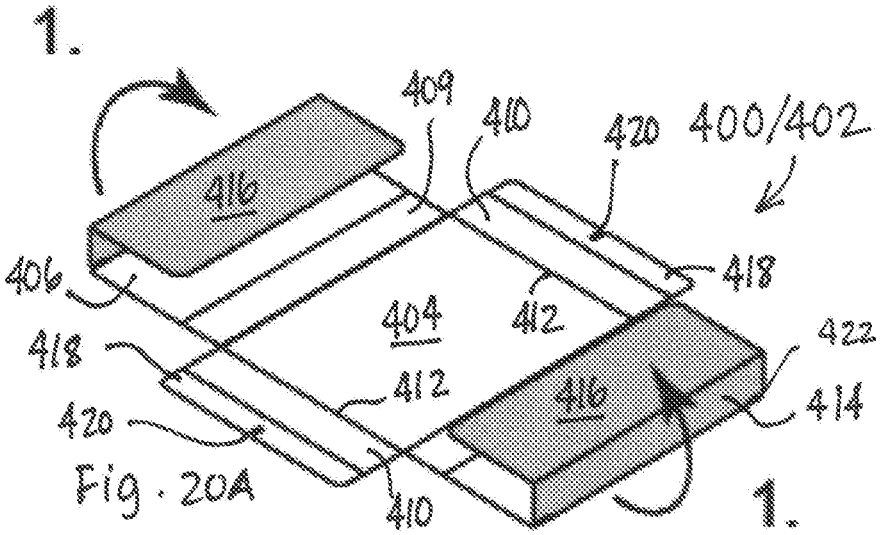
FIGS. 20A-20C are perspective views of an embodiment of the bottom filler constructed in accordance with the present disclosure being formed with the blank of FIG. 19, showing folding steps schematically with numbered arrows.
Figure 20B:
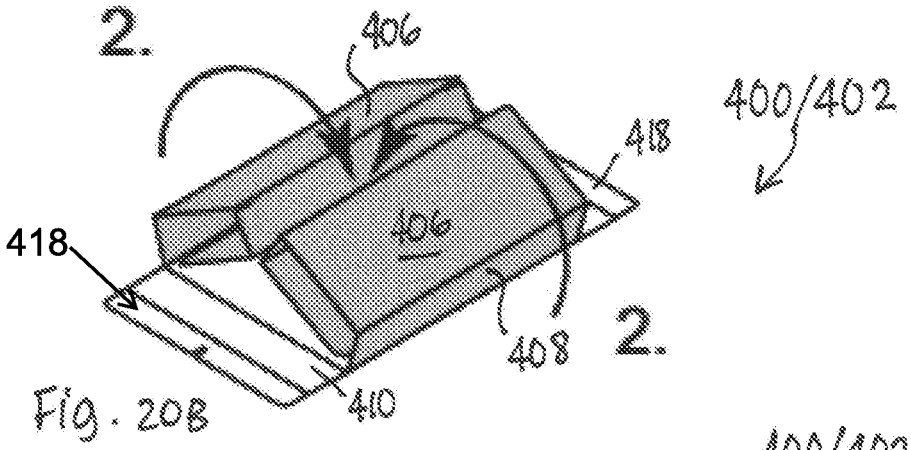
Figure 20C:
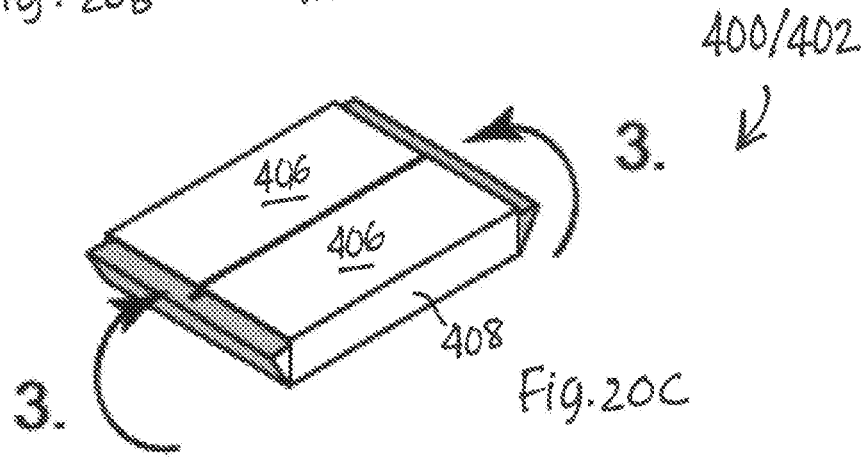

As shown in FIGS. 20A-20B, a method for assembling blank 400 into bottom filler 402 includes folding the side support panel 414 and the bottom support panel 416 are folded inward about their respective fold lines 412, shown schematically by the arrows of FIG. 20A. The first bottom filler panel 406 is folded about fold line 412 between bottom filler panel 406 and front filler panel 408. The second bottom filler panel 406 is folded about fold line 412 between bottom filler panel 406 and back filler panel 409, shown schematically by arrows of FIG. 20B. As shown in FIG. 20C, each filler side panel 410 is folded about its respective fold line 412 toward top filler panel 404. Each securing flap 418 is folded about its respective fold line 412 relative to its respective filler side panel 410 and each slot 420 is engaged with a pair of slots 422 to secure the bottom filler panels 406 in place.

Figure 21A:
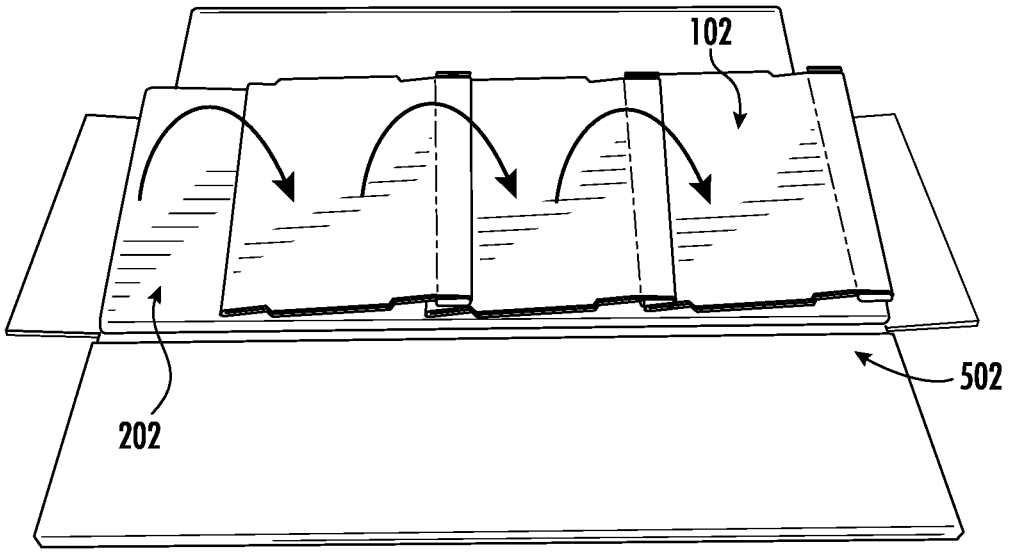
FIG. 21A is a perspective view of the frame and shelves of FIG. 16C with the shelves folded downward, as indicated schematically by the arrows, shown arranged on a blank for the master shipping container.
Figure 21B:
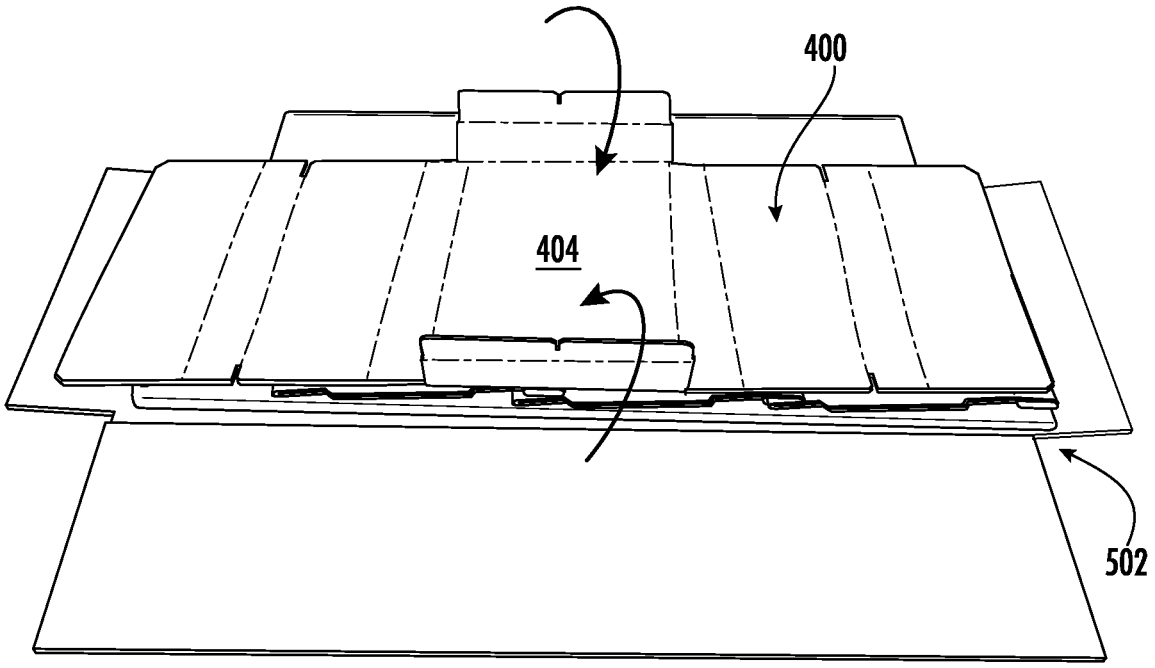
FIGS. 21B-C is a perspective view of the bottom filler blank of FIG. 19 being positioned on top of the shelves to be included in the shipping container, showing the panels attached to the top filler panel being folded inward for compact shipping.
Figure 21C:
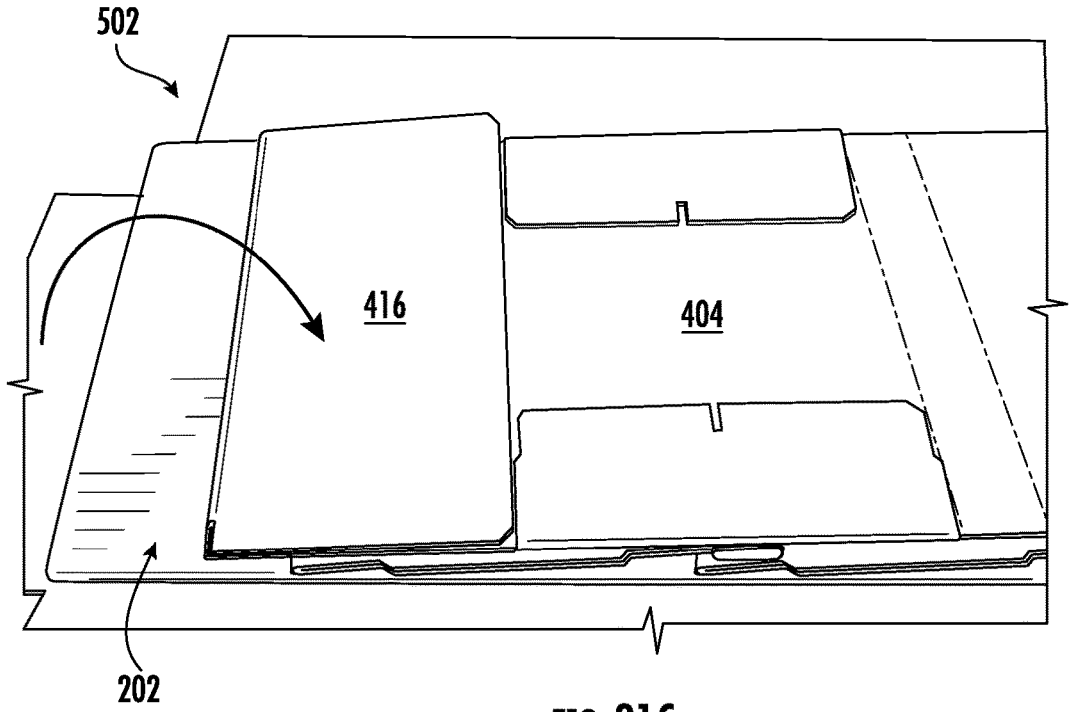
Figure 21D:
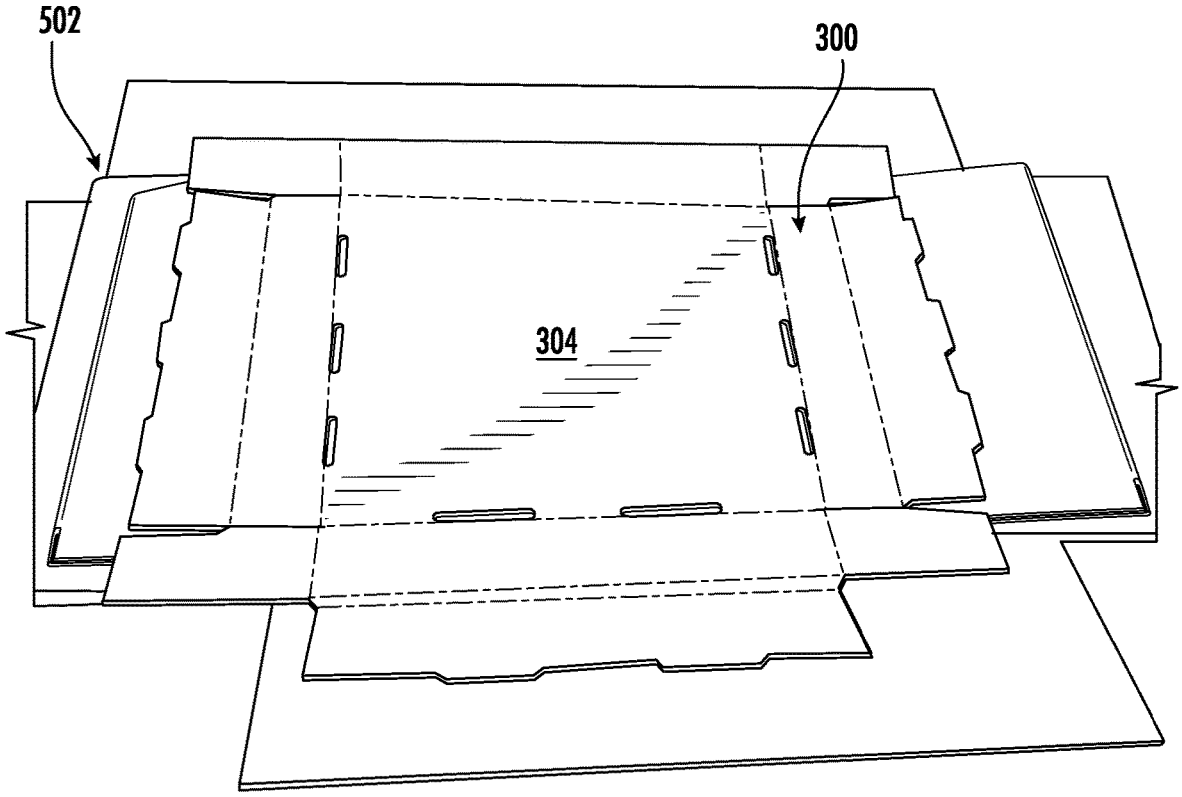
FIG. 21D is a perspective view of the blank of FIG. 17 being positioned on top of the bottom filler blank for compact shipping.
Figure 22:
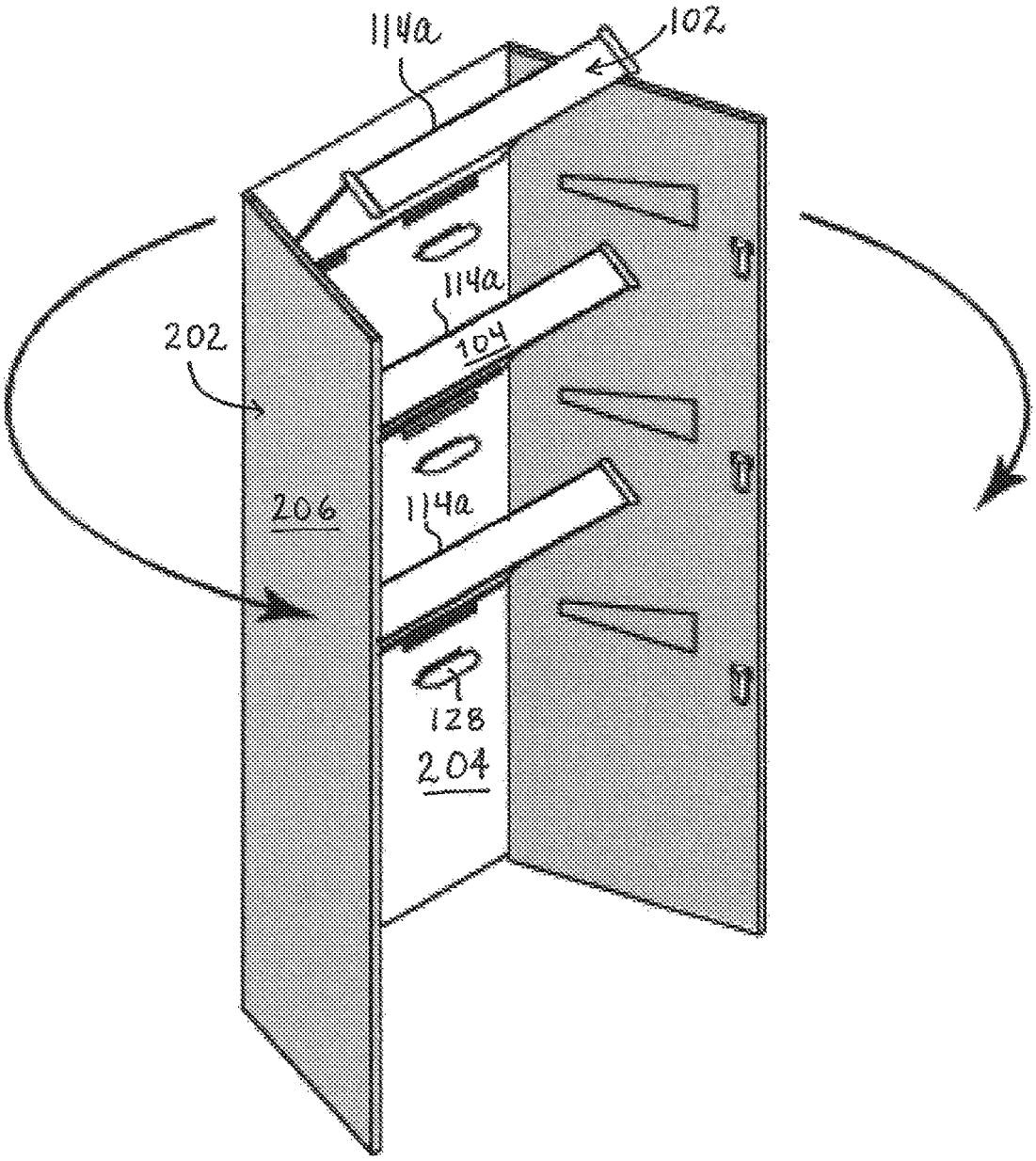
FIG. 22 is a perspective view of the frame and shelves of FIG. 16C, showing the frame side panels being unfolded and the shelves being lowered to form the shelving unit system.
Figure 23:
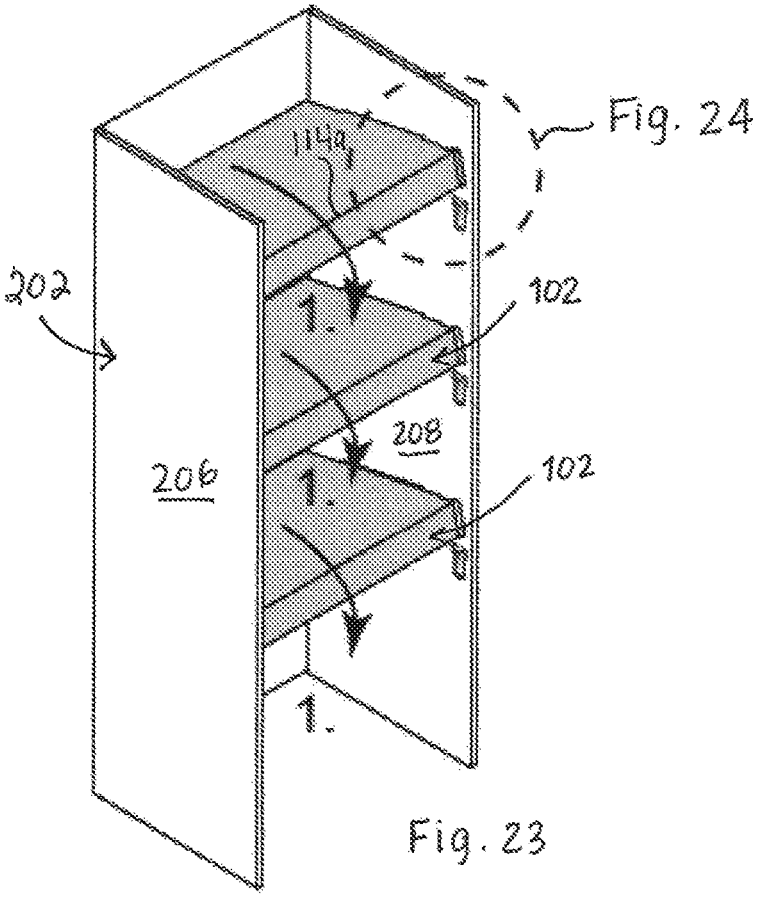
FIG. 23 is a perspective view of the frame and shelves of FIG. 16C, showing support clips of the shelves being engaged with respective support panel tracks of the frame.
Figure 24:
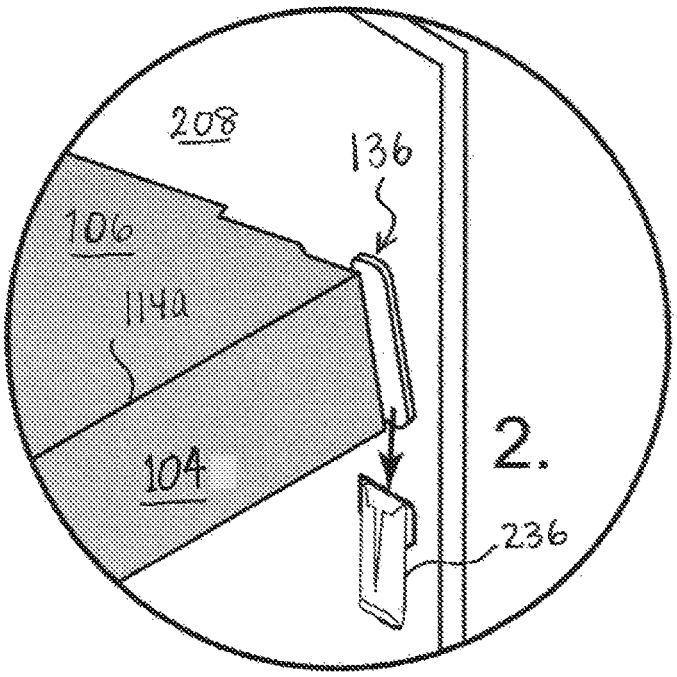
FIG. 24 is a perspective view of an enlarged portion of the frame and shelves of FIG. 16C, showing the support clips being engaged with respective support panel tracks of the frame.

As shown in FIGS. 21A-21D, for shipping, shelving unit 10 can be disassembled in a disassembled flattened state. Shelves 102 are assembled into frame 202 and shelves 102 are folded down, as indicated schematically by the arrows in FIG. 21A. Frame 202 and shelves 102 are positioned on top of a master shipping container 502. In FIGS. 21B-C bottom filler blank 400 is positioned on top of shelves 102 and portions thereof are folded inward to reduce the shipping footprint. As shown in FIG. 21D, bottom tray blank 300 is positioned on top of bottom filler blank 400. Panels of blank 300 can also be folded inward for shipping. With reference now to FIGS. 23-24, after shipping, shelving unit 10 can be assembled as shown. Shelves 102 are folded down and shelf clips 136 of the shelves are engaged with respective support panel tracks 236 of the frame. Tabs 105 extending from each top panel 106 and primary bottom panel 116 engage with support slots 207 of side support panels 208 of frame 202. Frame 202 can then be positioned within tray 302 and bottom filler 402 can be inserted within tray 302 such that frame 202 is between bottom filler 402 and tray 302, as shown in FIG. 1.

While shown and described in the exemplary context of a hutch-style display, those skilled in the art will readily appreciation that any other suitable container style can be formed without departing from the scope of this disclosure. Shelves 102 can be used in a variety of shelving units other than those with frame 202, filler 402 and tray 302. Moreover, while described in the context of supporting heavy items, a variety of items may be displayed. Blanks and containers as disclosed herein can be constructed of any suitable material such as corrugated paper board. The methods and systems of the present disclosure, as described above and shown in the drawings, provide for shelves and displays with superior properties including reduced shelf sagging and increased weight capacity for product. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A shelf comprising:

a plurality of panels connected together at a plurality of fold lines, the plurality of panels including a front panel, a top panel, a bottom panel and a back panel, wherein the top panel defines an upper surface configured to receive and support one or more items thereupon, wherein the top panel is connected to the front panel by a first fold line that includes a first line of weakness having an arcuate shape, wherein the top panel is connected to the back panel by a second fold line that includes a second line of weakness having an arcuate shape, wherein the first and second fold lines form arcuate edges on respective front and back sides of the top panel, wherein the arcuate edges are configured to cause an upward bowing in at least a portion of the top panel so as to provide additional support for the shelf.

2. The shelf as recited in claim 1, wherein respective inner surfaces of the top and bottom panels are adhered to one another.

3. The shelf as recited in claim 1, wherein the bottom panel includes a primary bottom panel and a secondary bottom panel.

4. The shelf as recited in claim 1, wherein the bottom panel includes a primary bottom panel and a secondary bottom panel, and wherein an intermediate bottom panel is connected between the primary and secondary bottom panels at fold lines.

5. The shelf as recited in claim 4, wherein the fold line between the secondary bottom panel and the intermediate bottom panel includes a line of weakness having an arcuate shape.

6. The shelf as recited in claim 1, wherein the bottom panel includes a primary bottom panel and first and second bottom angled panels, wherein the first and second bottom angled panels form a bottom panel support beam, wherein the first bottom angled panel is connected to the primary bottom panel at a respective fold line and the second bottom angled panel is connected to the first bottom angled panel at a support beam fold line, wherein the support beam fold line includes a line of weakness having an arcuate shape.

7. The shelf as recited in claim 6, wherein the bottom panel includes a bottom adhesion panel, wherein the bottom adhesion panel is connected to the second bottom angled panel at a respective fold line.

8. The shelf as recited in claim 1, further comprising two front adhesion panels, wherein a first one of the two front adhesion panels is connected to the front panel at a fold line, and wherein a second one of the two front adhesion panels is connected to the first front adhesion panel at an adhesion panel fold line, and wherein the first and second front adhesion panels are folded about the adhesion panel fold line to abut one another.

9. The shelf as recited in claim 8, further comprising a shelf clip adhered to at least one of the first or second adhesion panels, wherein the shelf clip is adhered between the first and second adhesion panels.

10. A blank for a shelf comprising:

a plurality of panels connected together along respective fold lines configured to be folded, including a front panel, a top panel, a bottom panel and a back panel, wherein the top panel defines an upper surface configured to receive and support one or more items thereupon when the shelf is formed from the blank, wherein the top panel is connected to the front panel by a first fold line that includes a first line of weakness having an arcuate shape, wherein the top panel is connected to the back panel by a second fold line that includes a second line of weakness having an arcuate shape, wherein the first and second fold lines form arcuate edges on respective front and back sides of the top panel, wherein the arcuate edges are configured to cause an upward bowing in at least a portion of the top panel when the shelf is formed from the blank so as to provide additional support for the shelf.

11. The shelf as recited in claim 1, wherein the bottom panel includes a primary bottom panel and a secondary bottom panel, and wherein an intermediate bottom panel is connected between the primary and secondary bottom panels at fold lines, wherein the fold line between the secondary bottom panel and the intermediate bottom panel includes a line of weakness having an arcuate shape.

12. A shelving unit system, the shelving unit system comprising:

a shelf including a plurality of shelf panels connected together at a first plurality of fold lines, the plurality of panels including a front shelf panel, a top shelf panel, a bottom shelf panel and a back shelf panel, wherein the top panel defines an upper surface configured to receive and support one or more items thereupon, wherein the top panel is connected to the front panel by a first fold line that includes a first line of weakness having an arcuate shape, wherein the top panel is connected to the back panel by a second fold line that includes a second line of weakness having an arcuate shape, wherein the first and second fold lines form arcuate edges on respective front and back sides of the top panel, wherein the arcuate edges are configured to cause an upward bowing in at least a portion of the top panel so as to provide additional support for the shelf; and a frame configured to engage with at least a portion of the shelf, wherein the frame includes a plurality of frame panels connected together at a second plurality of fold lines, the plurality of frame panels including a back frame panel, first and second side frame panels, and first and second side support panels.

13. The shelving unit system as recited in claim 12, wherein the top shelf panel includes a tab extending therefrom, and wherein the back frame panel includes a slot, wherein the tab of the top shelf panel engages with the slot of the back frame panel.

14. The shelving unit system as recited in claim 12, further comprising a bottom tray configured to receive a bottom portion of the frame, wherein the bottom tray includes a plurality of panels connected together at fold lines configured for extending at least partially around an interior space, including a bottom tray panel, a front tray panel, a first tray side panel, a back tray panel and a second tray side panel.

15. The shelving unit system as recited in claim 14, further comprising a bottom filler configured to nest within the bottom tray, wherein the bottom filler includes a plurality of panels connected together at fold lines configured for extending at least partially around an interior space, including a top filler panel, a bottom filler panel, a front filler panel, a first filler side panel, a back filler panel and a second tray side panel.

* * * * *